US008776693B2

(12) United States Patent
Toeckes et al.

(10) Patent No.: US 8,776,693 B2
(45) Date of Patent: Jul. 15, 2014

(54) APPARATUS AND METHOD FOR DISPENSING INCENDIARY PROJECTILES

(75) Inventors: Mark D. Toeckes, Delta (CA); Earl D. Trautman, Delta (CA); Edward S. Vanderploeg, Surrey (CA)

(73) Assignee: Donmark Holdings Inc., Delta (CA)

( * ) Notice: Subject to any disclaimer, the term of this patent is extended or adjusted under 35 U.S.C. 154(b) by 621 days.

(21) Appl. No.: 12/528,943

(22) PCT Filed: Feb. 27, 2008

(86) PCT No.: PCT/CA2008/000359

§ 371 (c)(1),
(2), (4) Date: Oct. 14, 2009

(87) PCT Pub. No.: WO2008/104061

PCT Pub. Date: Sep. 4, 2008

(65) Prior Publication Data

US 2010/0101401 A1 Apr. 29, 2010

Related U.S. Application Data

(60) Provisional application No. 60/891,939, filed on Feb. 27, 2007.

(51) Int. Cl.

| | |
|---|---|
| ***F42B 12/44*** | (2006.01) |
| ***A62C 3/08*** | (2006.01) |
| ***F41A 9/50*** | (2006.01) |
| ***F41F 5/00*** | (2006.01) |
| ***F41A 19/01*** | (2006.01) |
| ***F41A 9/48*** | (2006.01) |
| ***F41F 7/00*** | (2006.01) |
| ***F41A 19/03*** | (2006.01) |
| ***F41A 17/06*** | (2006.01) |
| ***F41A 9/22*** | (2006.01) |

(52) U.S. Cl.

CPC ... *F41A 9/22* (2013.01); *A62C 3/08* (2013.01); *F41A 9/50* (2013.01); *F41F 5/00* (2013.01); *F41A 19/01* (2013.01); *F41A 9/48* (2013.01); *F41F 7/00* (2013.01); *F41A 19/03* (2013.01); *F41A 17/06* (2013.01); *F42B 12/44* (2013.01)

USPC ..... 102/364; 89/1.51

(58) Field of Classification Search

USPC ..... 89/1.51, 1.52; 102/364, 366; 221/277; 169/60, 61

See application file for complete search history.

(56) References Cited

U.S. PATENT DOCUMENTS

| | | | | |
|---|---|---|---|---|
| 2,631,769 | A * | 3/1953 | Everett | 141/138 |
| 5,062,543 | A * | 11/1991 | Germain | 221/30 |
| 5,282,454 | A * | 2/1994 | Bell et al. | 124/49 |
| 5,816,232 | A * | 10/1998 | Bell | 124/51.1 |
| 6,952,169 | B1 * | 10/2005 | Simtion | 340/577 |
| 7,275,529 | B2 * | 10/2007 | Boys | 124/66 |
| 7,451,679 | B2 * | 11/2008 | Stevenson et al. | 89/1.51 |

* cited by examiner

*Primary Examiner* — Daniel J Troy
(74) *Attorney, Agent, or Firm* — Nexus Law Group LLP

(57) ABSTRACT

An apparatus and method for dispensing incendiary projectiles is provided. The apparatus includes an injector for injecting the projectiles with a reactant at a dispensing rate, and a controller operable to control the dispensing rate. The controller is operable to control solenoids of a dispenser gate and a shuttle motor, and to prevent jam conditions of the apparatus. The apparatus can detect and automatically correct jam conditions that do occur. The apparatus can count the number of incendiary projectiles dispensed during a current operation and during the lifetime of the apparatus. The apparatus is dimensioned to minimize the number of incendiary projectiles purged from the apparatus after an operator has indicated to stop dispensing.

18 Claims, 17 Drawing Sheets

APPARATUS AND METHOD FOR DISPENSING INCENDIARY PROJECTILES

BACKGROUND OF THE INVENTION

1. Field of Invention

This invention relates to intentional burning for land and forestry management and, in particular, to an apparatus, method and system for dispensing incendiary projectiles.

2. Description of Related Art

Prescribed burning is the intentional burning of typically forested areas to meet specific land management objectives, such as to reduce flammable fuels, restore ecosystem health, recycle nutrients, or prepare an area for new trees or vegetation.

Devices for igniting prescribed fires include conventional hand-held and aerial ignition devices. Conventional aerial ignition devices are typically mounted on a helicopter; receive plastic spheres containing an incendiary material, such as potassium permanganate; inject the received spheres with a reactant, such as ethylene glycol; and then expel the injected spheres to fall from the helicopter. A delayed exothermic reaction between the incendiary material and the reactant within the spheres can produce a prescribed fire where the spheres land. The delay of the exothermic reaction is typically 25 to 30 seconds.

Conventional hand-held ignition devices typically operate by dripping or throwing flaming fuel onto flammable materials such as ground vegetation. However, such conventional hand-held devices require an operator to be present on the ground at the prescribed fire, and are not suitable for aerial use due to their restricted size and output and safety concerns.

Some conventional aerial ignition devices dispense incendiary capsules obtained from capsule belts stored in magazines. However, such conventional aerial ignition devices require the use of capsule belts of specific and restricted dimensions, and are not suitable for dispensing spheres or other free flowing projectiles. Also, the belts and magazines become unusable waste after the capsules have been removed therefrom.

Some conventional aerial ignition devices permit adjustment of the desired rate of operation of the device. However, such conventional aerial ignition devices do not regulate the rate of operation. Thus, such conventional aerial ignition devices cannot correlate the rate of operation with a desired rate of operation.

Some conventional aerial ignition devices inject varying amounts of reactant into the spheres depending on the selected desired rate of operation of the device, thereby reducing the incendiary effectiveness of the injected spheres.

Some conventional aerial ignition devices include an electrically powered fire extinguisher for extinguishing fires located within the device. However, the fire extinguishers of such conventional devices do not operate when power to the device fails or becomes otherwise disconnected.

Aerial ignition devices typically require spheres to be expelled from the device after the user has stopped the flow of received spheres, thereby requiring the user to judge when to stop the flow of received spheres in order to consequently stop spheres from being expelled at a desired time. Thus, it would be desirable in the art to minimize the number of spheres expelled from the device after the flow of received spheres has been stopped. Conventional aerial ignition devices do not minimize the number of spheres expelled from the device after the flow of received spheres has been stopped.

Aerial ignition devices typically jam and/or break spheres in the device under conditions of misalignment. Thus, it would be desirable in the art to minimize the effect of jamming and breaking of spheres within the device. Conventional aerial ignition devices do not effectively address the problem of jamming and breaking of spheres within the device.

Some conventional aerial ignition devices cannot count the number of spheres being expelled.

However, such conventional aerial ignition devices may exhibit abnormal behavior when the solenoid or similar device de-energizes as a result of a failure or other disconnection of power to the device.

Some conventional aerial ignition devices do not have a removable base, thereby hindering installation of the device on the helicopter.

Prior art projectiles lack multi-coloured exteriors, thereby hindering their visibility, and are large and bulky.

SUMMARY

The above shortcomings may be addressed by providing, in accordance with one aspect of the invention, an apparatus for dispensing projectiles. The apparatus includes: an injector for injecting the projectiles with a reactant at a dispensing rate; and a controller operable to control the dispensing rate.

The apparatus may include a hopper for storing projectiles prior to being received by the injector; a hopper motor for agitating projectiles within the hopper; one or more dispenser gates operable to control the entry of projectiles to the injector; one or more solenoids for displacing the one or more dispenser gates; a shuttle operable to receive one or more projectiles from the hopper; a shuttle motor operable to rotate an output shaft of the shuttle motor; a shuttle cam for translating rotational motion to reciprocating motion; an injector needle for puncturing a projectile; an injector pump for supplying reactant to the injector needle; a dispenser chute operable to receive projectiles from the injector; a fire extinguisher system; a fire extinguisher system battery; one or more momentary switches; one or more user output indicators; and any combination thereof.

The apparatus may be dimensioned to minimize the number of projectiles between the one or more dispenser gates and the shuttle. The injector pump may be a constant displacement pump.

The controller may be operable to control the operation of the hopper motor. The controller may be operable to control the flow of projectiles from the hopper through the hopper exit to the injector. The controller may be operable to control the opening and closing of the one or more dispenser gates. The controller may be operable to control the extension and retraction of a gate pin of the one or more dispenser gates. The controller may be operable to control the one or more solenoids. The controller may be operable to prevent manual opening of the one or more dispenser gates. The controller may be operable to permit manual closing of the one or more dispenser gates. The controller may be operable to prevent the hopper motor from starting to operate until after the one or more dispenser gates have been closed. The controller may be operable to prevent the opening of the one or more dispenser gates until after the elapse of a time delay following the start of operation of the hopper motor. The controller may be operable to control the one or more solenoids to close the one or more gates after the elapse of a time delay following an unsuccessful attempt to close the one or more gates.

The controller may be operable to control the dispensing rate by controlling an output speed of a shuttle motor of the injector. The controller may be operable to start and stop operation of the shuttle motor. The controller may be operable to receive as an input an indication of a desired output speed of the shuttle motor. The controller may be operable to receive as an input an indication of the output speed of the shuttle motor. The controller may be operable to control the output speed of the shuttle motor by closed loop feedback. The controller may be operable to prevent the shuttle motor from operating when the one or more dispensing gates are closed. The controller may be operable to prevent the shuttle motor from operating at the desired output speed until after the elapse of a time delay following the start of operation of the shuttle motor. The controller may be operable to prevent the shuttle motor from operating until after the elapse of a time delay following the opening of the one or more dispenser gates. The controller may be operable to control an output direction of the shuttle motor. The controller may be operable to detect an abnormal output speed of the shuttle motor. The controller may be operable to permit manual control of motion of the shuttle. The controller may be operable to prevent the stopping of the shuttle motor until after the elapse of a time delay following the closing of the one or more dispenser gates. The controller may be operable to prevent the stopping of the shuttle motor until after the occurrence of a specifiable number of revolutions of the shuttle motor following the closing of the one or more dispenser gates.

The controller may be operable to count the number of projectiles injected, the number of projectiles dispensed, and any combination thereof. The controller may be operable to count the number of projectiles injected, the number of projectiles dispensed, and any combination thereof, during the lifetime of the apparatus. The controller may be operable to receive as an input an indication of the number of output revolutions of the shuttle motor.

The controller may be operable to receive as input an indication of the amount of extinguishing agent in the extinguisher receptacle of the fire extinguisher system. The controller may be operable to prevent the dispensing operation from starting when the amount of extinguishing agent is insufficient.

The fire extinguisher system may be operable when power to other components of the apparatus is disconnected.

In accordance with another aspect of the invention, there is provided a method of dispensing projectiles. The method involves: injecting the projectiles with a reactant at a dispensing rate; and controlling the dispensing rate.

Other aspects and features of the present invention will become apparent to those of ordinary skill in the art upon review of the following description of embodiments of the invention in conjunction with the accompanying figures.

BRIEF DESCRIPTION OF THE DRAWINGS

In drawings which illustrate by way of example only embodiments of the invention.

DETAILED DESCRIPTION

An apparatus for dispensing projectiles includes: injecting means for injecting the projectiles with a reactant at a dispensing rate; and controlling means for controlling the dispensing rate.

Figure 1:
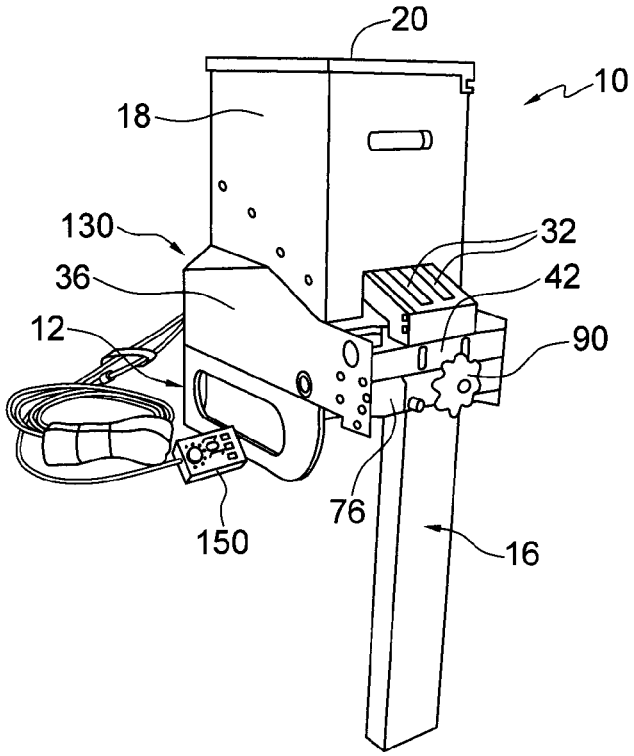
FIG. 1 is a perspective view of an apparatus for dispensing projectiles according to a first embodiment of the invention.
Figure 2:
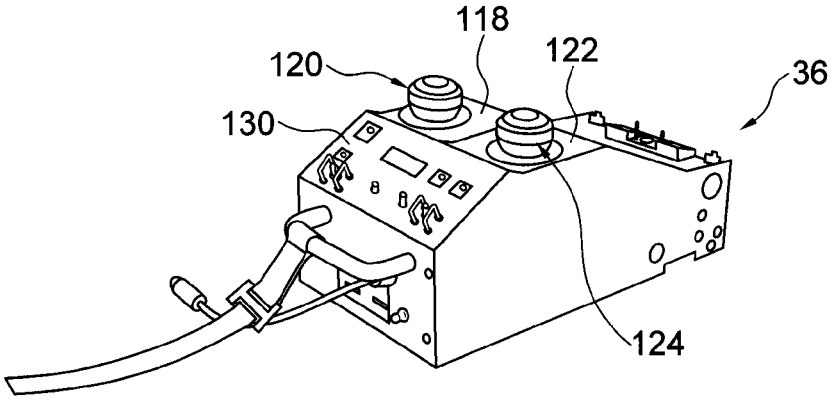
FIG. 2 is a perspective view of a container assembly of the apparatus shown in FIG. 1, showing a main panel.
Figure 3:
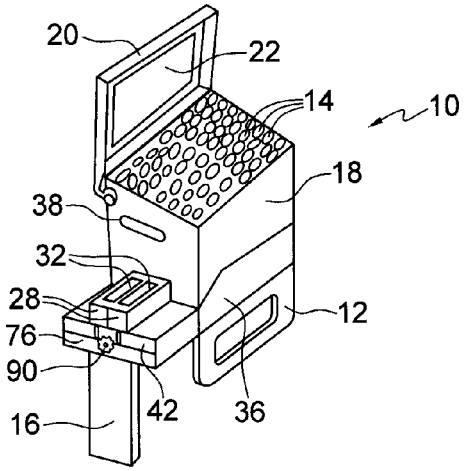
FIG. 3 is a perspective view of the apparatus shown in FIG. 1, showing projectiles in a hopper.

Referring to FIGS. 1 to 4, the apparatus according to a first and preferred embodiment of the invention is shown generally at 10 (FIGS. 1 and 3). The apparatus 10 is operable to receive objects such as the free flowing incendiary projectiles 14 shown in FIG. 3, inject the projectiles 14 with a reactant and dispense the injected projectiles 14, including dispensing the injected projectile 14 through a dispenser chute 16. In use, the apparatus 10 typically hangs from or is otherwise mounted on an aircraft such as a helicopter (not shown), such that the dispensed projectiles 14 are expelled from the aircraft to cause prescribed burning on the ground below the helicopter.

The apparatus 10 shown in FIGS. 1 and 3 includes a base 12 for installing the apparatus 10 to the aircraft. Preferably, the base 12 is removably attachable to the remainder of the apparatus 10, thereby facilitating installation of the apparatus 10 to the aircraft. The apparatus 10 may be installed with or without the base 12 attached to the apparatus 10, as may be suitable for a given aircraft. The base 12 may be dimensioned for one or more particular aircraft, such as particular models of helicopter for example. Different bases 12 dimensioned for different aircraft may be provided such that the apparatus 10 may be readily removably attached to a variety of different aircraft.

Figure 4:
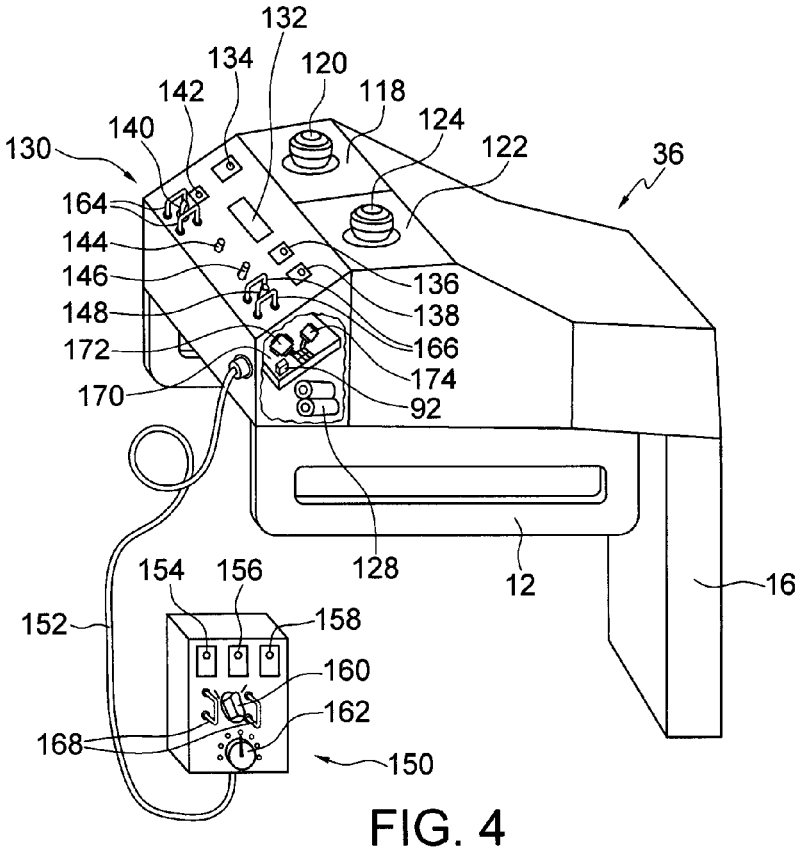
FIG. 4 is a perspective view of a container assembly of the apparatus shown in FIG. 1, showing a main circuit board by cut-out.

The apparatus 10 may receive its main power source (not shown) from the aircraft to which the apparatus 10 is installed. Referring to FIG. 4, the apparatus 10 preferably includes a controller for regulating the operation of the apparatus 10, including controlling a dispensing rate of the apparatus 10. The controller is implemented on one or more electronic circuit boards, such as the main circuit board 170 shown by cut-out in FIG. 4.

While the projectiles 14 shown in FIG. 3 are substantially spherical in shape and are all of substantially the same size, other shapes and sizes are contemplated within the scope of the present invention. Dimensions of the apparatus 10 and its components may be suitably varied to suit projectiles 14 of varying sizes and shapes. Each projectile 14 may be formed of a plastic spherical exterior and contain therein an incendiary material, such as potassium permanganate or any suitable substitute thereof. Each projectile 14 may have a colored exterior, including a multi-colored exterior. For example, the exterior of projectiles 14 may be orange and black, thereby enhancing the visibility of the projectiles 14 and rendering the projectiles 14 highly visible. Highly visible projectiles 14 advantageously decrease the likelihood of misplacing a projectile 14 and being unable to locate the misplaced projectile 14, such that the safety hazard of hidden or waylaid projectiles 14 is minimized.

The apparatus 10 includes a hopper 18 dimensioned to be able to contain a suitable number of the projectiles 14. For example, the hopper 18 may be dimensioned to advantageously contain as many as 950 suitably sized projectiles 14. Other dimensions for the hopper 18 are contemplated within the scope of the present invention.

A hopper lid 20 is hingedly connected to the hopper 18 near the top of the hopper 18. FIG. 1 shows the hopper lid 20 in the closed position, and FIG. 3 shows the hopper lid 20 in the open position to reveal projectiles 14 in the hopper 18. The hopper 18 and the hopper lid 20 are preferably dimensioned to permit the hopper lid 20 to open in one of a plurality of selectable directions, thereby advantageously providing additional options for use of the apparatus 10 in the constrained space of an aircraft. For example, the hopper lid 20 may be configured to open toward or away from a given side of the apparatus 10. Preferably, the hopper lid 20 can be removed from the hopper 18 entirely. In some embodiments, the hopper lid 20 is removable without the use of tools. For example, the hopper lid 20 may be lifted upwards at an appropriate angle to release the hopper lid 20 from hinge pins of the hopper 18. In some embodiments, the hopper lid 20 can be secured to the hopper 18 such that the hopper lid 20 is not removable without the use of a tool. For example, the hopper lid 20 may be secured to the hopper 18 by opposing fasteners such as shoulder bolts (not shown). The hopper 18 and the hopper lid 20 may be dimensioned to permit the hopper lid 20 to be secured atop the hopper 18 in the closed position (FIG. 1), including possibly being locked in the closed position. The hopper lid 20 preferably includes a hopper lid window 22, thereby advantageously rendering the interior of the hopper 18 visible. The hopper lid window 22 is made of a clear polycarbonate or other suitable material.

Referring to FIGS. 5 to 8, the apparatus 10 includes a hopper motor 24. The hopper motor 24 is operable to agitate the projectiles 14 contained within the hopper 18. In the first embodiment, the hopper motor 24 is operable to produce orbital rotation of a hopper output orbital shaft 26 (see FIG. 7 for example), which is slidably and hingedly connected to a hopper lower plate 30 such that the orbital rotation of the hopper output orbital shaft 26 causes reciprocating motion of the hopper lower plate 30, thereby agitating the projectiles 14 in contact with the hopper lower plate 30. The hopper lower plate 30 preferably has projecting therefrom a plurality of projectile guides 34 (see FIG. 8 for example) for agitatingly guiding the projectiles 14 toward one or more hopper exits 28. The reciprocating motion of the hopper lower plate 30 is preferably directed transversely to the guidance direction of the projectile guides 34. The hopper exits 28 in turn guide the agitated projectiles 14 as they exit from the hopper 18. Preferably, the hopper 18 includes a pair of hopper exits 28, each hopper exit 28 having a hopper exit window 32 for displaying the projectiles 14 as they pass through the hopper exit 28. The hopper exit windows 32 advantageously permit monitoring of the flow of the projectiles 14 through the hopper exits 28.

Agitation of the projectiles 14 advantageously facilitates the flow of projectiles 14 in, through and/or from the hopper 18. The hopper motor 24 may be a single speed motor that agitates projectiles 14 in the hopper 18 when activated, and stops agitating projectiles 14 in the hopper 18 when de-activated.

Figure 7:
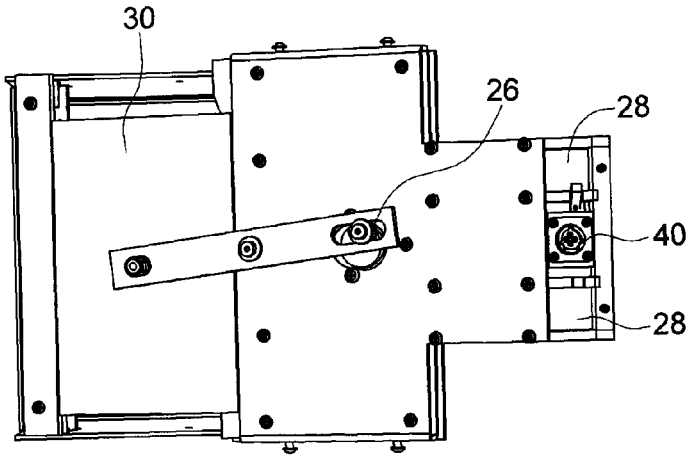
FIG. 7 is a bottom view of a lower plate of the hopper of FIGS. 5 and 6.
Figure 8:
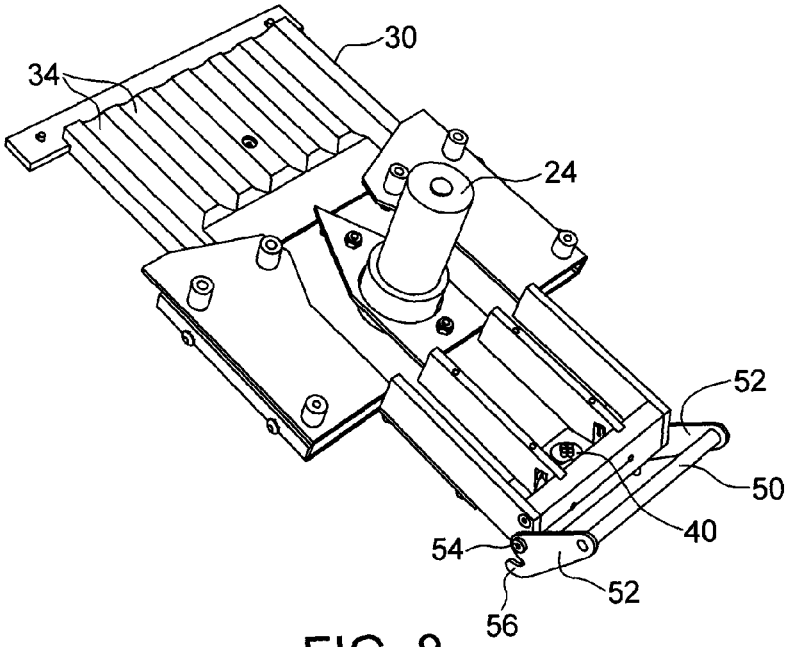
FIG. 8 is a top view of the lower plate shown in FIG. 7.

Referring back to FIGS. 1 to 4, the hopper 18 is preferably removably attachable to a container assembly 36 of the apparatus 10. The hopper 18 may include one or more hopper apertures 38 suitably dimensioned for gripping by hand. For example, the hopper 18 may include two opposingly located hopper apertures 38, only one of which is shown in FIGS. 1 and 3. The hopper 18 may include one or more hopper exit stops (not shown in FIGS. 1 to 4) to prevent projectiles 14 from exiting the hopper exits 28 when the hopper 18 is removed from the container assembly 36. The hopper 18 and the container assembly 36 preferably include mating electrical connectors for connecting electrical power to the hopper motor 24. FIGS. 7 and 8 show the hopper electrical connector 40 of the hopper 18. In the first embodiment, the mating connectors are dimensioned for automatic mating, thereby advantageously permitting the rapid removal of the hopper 18 from the remainder of the apparatus 10, such as may be necessary during an emergency.

Figure 6:
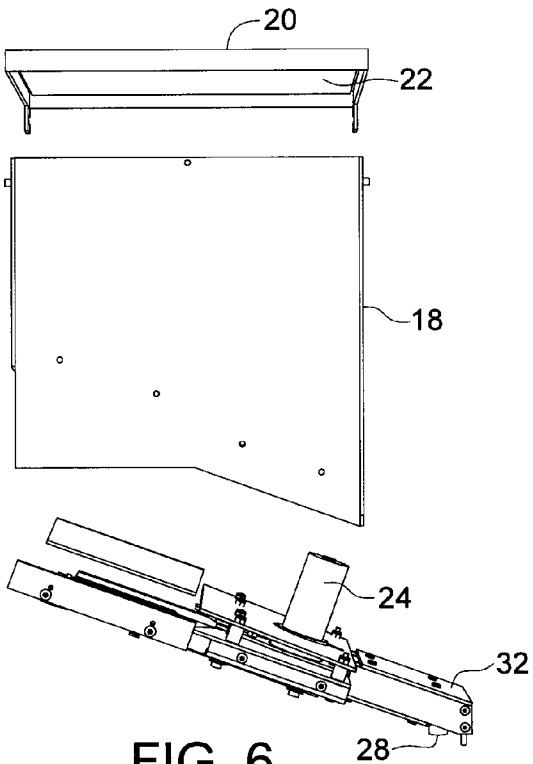
FIG. 6 is an exploded perspective view from the side of the hopper shown in FIG. 5.
Figure 5:
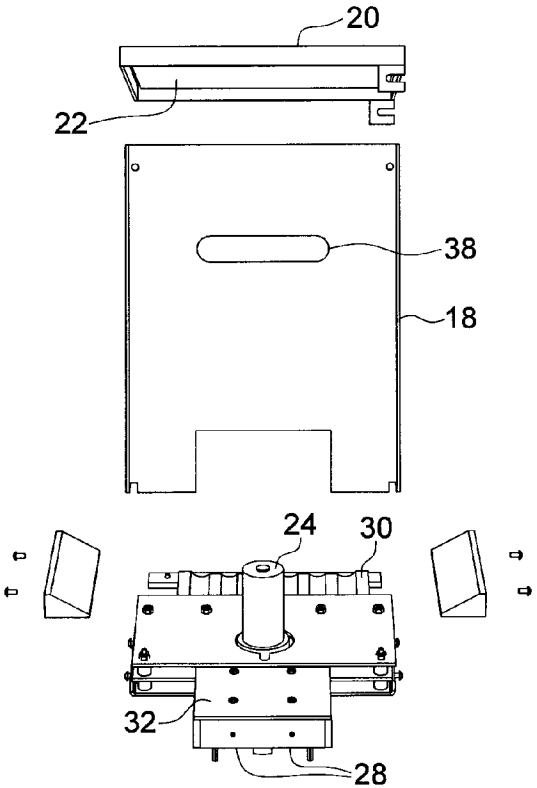
FIG. 5 is an exploded perspective view from the front of a hopper of the apparatus of FIG. 1.

Referring to FIGS. 9 to 13, a dispenser gate 42 is shown having gate passages 44. The apparatus 10 is preferably dimensioned such that the gate passages 44 are in substantial alignment with associated hopper exits 28 (FIGS. 5 to 7). In the first embodiment, the dispenser gate 42 is operable to permit projectiles 14 to pass through the gate passages 44 when the gate pins 46 are in non-blocking positions such that the gate pins 46 are not blocking the gate passages 44. The dispenser gate 42 is operable to block projectiles 14 from passing through the gate passages 44 when the gate pins 46 are in blocking positions substantially blocking the gate passages 44.

Figure 9:
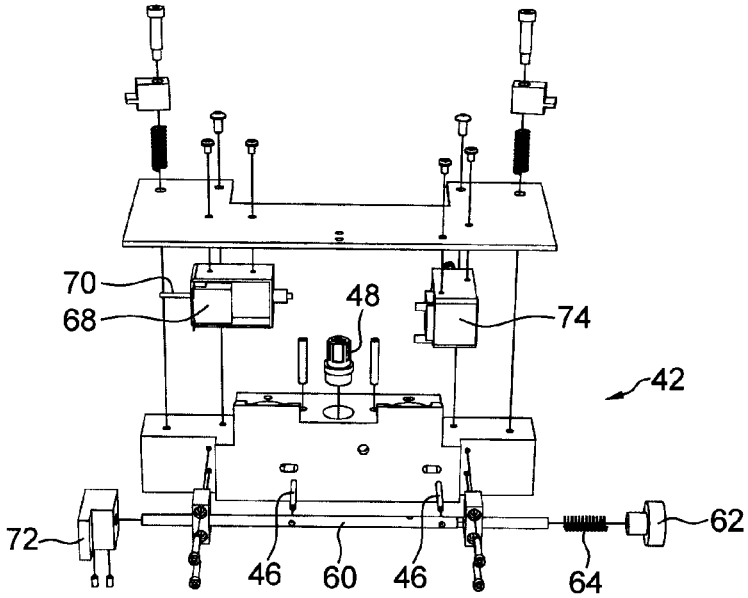
FIG. 9 is an exploded perspective view from the back of a dispenser gate of the apparatus shown in FIG. 1.
Figure 10:
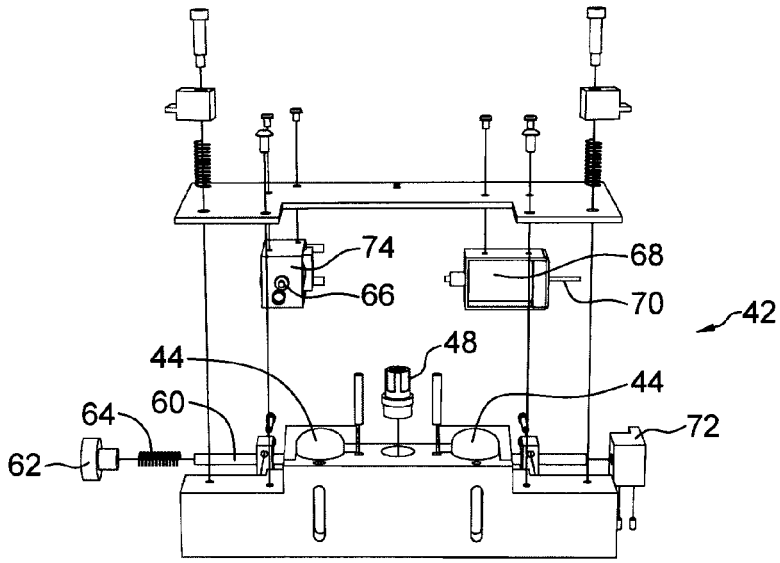
FIG. 10 is an exploded perspective view from the front of the dispenser gate shown in FIG. 9.
Figure 11:
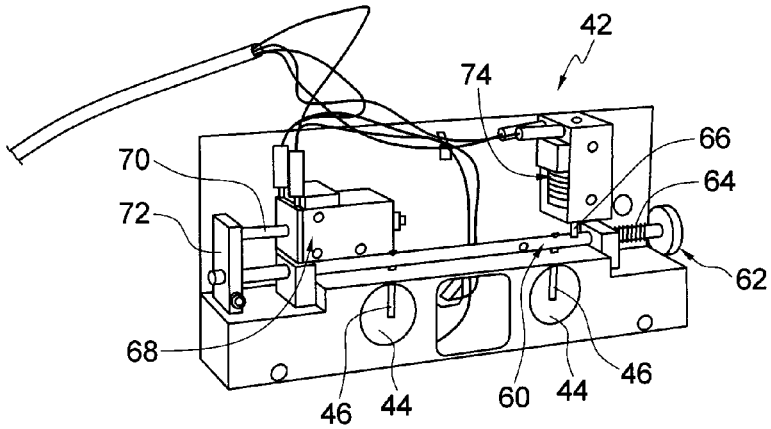
FIG. 11 is a bottom view of the dispenser gate shown in FIGS. 9 and 10.
Figure 12:
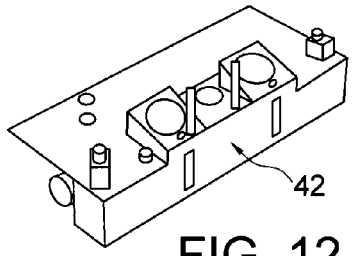
FIG. 12 is a top view of the dispenser gate shown in FIGS. 9, 10 and 11.
Figure 13:
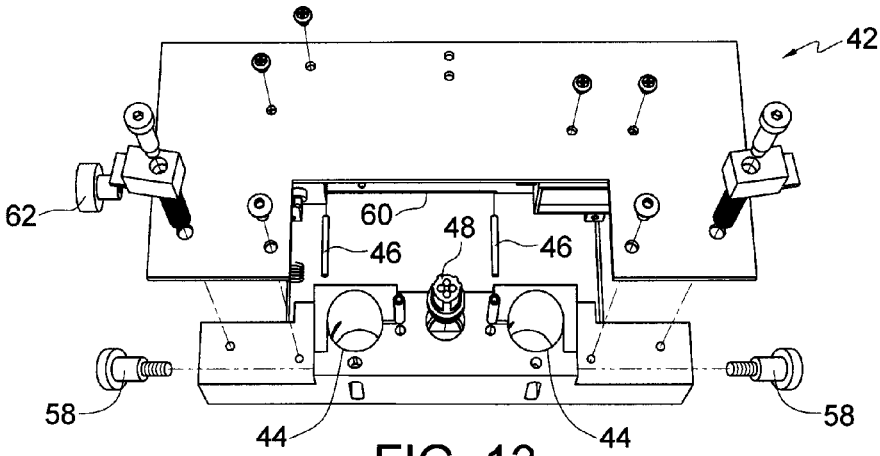
FIG. 13 is an exploded perspective view from the top of the dispenser gate shown in FIGS. 9 to 12.

FIGS. 9, 10 and 13 show the electrical connector 48 that, in the first embodiment, is dimensioned for automatic mating with the hopper electrical connector 40 (FIG. 7).

Referring back to FIG. 8, the hopper 18 in some embodiments is lockably and removably attachable to the dispenser gate 42. For example, the hopper 18 in some embodiments includes a rotatable hopper handle 50 having handle side plates 52 at opposing ends of the hopper handle 50. The handle side plates 52 are mounted to the hopper 18 by hopper handle mounting bolts 54 (only one of which is visible in FIG. 8) that pass through apertures (not visible in the drawings) of the handle side plates 52. Each handle side plate 52 forms a locking projection 56 and a recess or slot defined by the handle side plate 52 between the locking projection 56 and the location of the apertures through which the hopper handle mounting bolts 54 pass. The hopper handle 50 is operable to rotate about an axis defined as extending between the opposing hopper handle mounting bolts 54. The hopper handle 50 is dimensioned such that rotating the hopper handle 50 in a downward direction causing the locking projections 56 to move toward the center of the apparatus 10, the slot defined by the handle side plates 52 lockingly engage with the dispenser gate 42 (not shown in FIG. 8). When locked, the handle 50 inhibits the hopper 18 from being separated from the remainder of the apparatus 10 during operation, thereby advantageously preventing the hopper 18 from being dislodged during operation and movement thereof and advantageously permitting lifting and carrying of the apparatus 10 by the handle 50. The hopper handle 50 can be released from locking engagement with the dispenser gate 42 by pulling upwardly and arcuately on the hopper handle 50, thereby moving the locking projections 56 away from the dispenser gate 42. When released, the handle 50 is advantageously rotatable to a vertical position (not shown) for lifting the hopper 18 by the hopper handle 50.

Referring to FIG. 13, the dispenser gate 42 in some embodiments includes projections, such as those formed by the shoulder bolts 58, for receiving engagement with the hopper handle 50. For example, the hopper handle 50 is operable when rotated downwardly to slidingly engage the shoulder bolts 58 by the handle side plates 52 at the slots defined therein so as to place the locking projections 56 adjacently below the shoulder bolts 58, respectively. The hopper handle 50 can be released from its locking position by rotating the hopper handle 50 such that the handle side plates 52 are slidingly moved away and disengaged from the shoulder bolts 58 of the dispenser gate 42.

Referring again to FIGS. 9 to 13, the gate pins 46 are preferably coupled to a feed control rod 60 having the gate knob 62 attached thereto. The operative coupling of the feed control rod 60 and the gate knob 62 advantageously permit the gate pins 46 to be manually pushed to their blocking positions, respectively, thereby manually closing the dispenser gate 42. The feed control rod spring 64 urges the feed control rod 60, gate knob 62 and gate pins 46 such that the gate pins 46 are resiliently urged toward their non-blocking positions, respectively. By way of example, pushing the gate knob 62 in an inward direction such that the feed control rod spring 64 is compressed, moves the feed control rod 60 longitudinally in that same direction and causes the gate pins 46 to transversely move in that same direction such that the gate pins 46 are moved toward the center of the gate passages 44 and hence into blocking positions.

In addition to manual closing of the dispenser gate 42, a gate closing solenoid 68 is preferably operable to automatically urge the gate pins 46 toward their blocking positions when the gate closing solenoid 68 is energized. In the first embodiment, the gate closing solenoid 68 is operable to extend its closing solenoid output plunger 70 toward an end plate 72 attached to the feed control rod 60 at the end of the feed control rod 60 opposite the gate knob 62.

A gate locking pin 66 is preferably resiliently urged toward the feed control rod 60 and positioned to lockably fit into a corresponding notch or aperture of the feed control rod 60 when the gate pins 46 are in their blocking positions so as to lock the gate pins 46 in their blocking positions, respectively. The locking mechanism for the gate pins 46 advantageously permits the gate closing solenoid 68 to de-energize without the gate pins 46 moving from their fully blocking positions under the urging of the feed control rod spring 64.

The gate opening solenoid 74 is operable to pull the gate locking pin 66 away from the feed control rod 60, thereby unlocking the gate pins 46. The gate pins 46 return to their non-blocking positions when unlocked by the force of the feed control rod spring 64. In the first embodiment, the gate locking pin 66 is implemented as the output plunger of the gate opening solenoid 74 such that the gate locking pin 66 is resiliently urged toward the feed control rod 60 by an internal resilience of the gate opening solenoid 74. For example, the gate opening solenoid 74 may include an internal spring (not shown) for resiliently urging its output plunger toward the fully extended position.

Referring to FIGS. 14 to 17, the injector 76 includes a shuttle 78, shuttle receptacles 80, a shuttle cam slot 79, shuttle cam slider blocks 81 and shuttle slider plates 84. The apparatus 10 is preferably dimensioned such that the shuttle receptacles 80 are in substantial alignment with their associated gate passages 44 such that projectiles 14 exiting from the gate passages 44 enter the shuttle receptacles 80, respectively. A shuttle motor 82 has a shuttle motor output shaft 86 attached to a shuttle cam 88. The shuttle cam 88 is slidably and rotatably connected to the shuttle 78. The shuttle motor 82 is preferably operable to rotate the shuttle cam 88 such that the shuttle 78 slidably reciprocates within the injector 76. In the first embodiment, the shuttle cam 88 is dimensioned to fit a portion of the shuttle cam 88 within the shuttle cam slot 79 between opposing shuttle cam slider blocks 81. Rotation of the shuttle motor output shaft 86 causes orbital motion of the shuttle cam 88 such that contact between the shuttle cam 88 and the shuttle cam slider blocks 81 causes reciprocal sliding of the shuttle 78 relative to the remainder of the injector 76. The shuttle slider plates 84 facilitate sliding of the shuttle 78 relative to the remainder of the injector 76. The shuttle cam slider blocks 81 and the shuttle slider plates 84 are preferably made from low-friction materials such as low-friction, wear-resistant plastic materials including Delrin (trademark) material. The use of low-friction materials advantageously reduces or eliminates the need for fluid lubrication between moving components of the injector 76, thereby minimizing maintenance requirements due to fluid lubricants becoming contaminated by dust or other particulate matter, including the contents of projectiles 14 which may have broken.

The structural portions of the apparatus 10 may be made of any suitable material, including aluminum, sheet metal, stainless steel metal, plastic and rubber, for example.

The shuttle motor 82 is preferably reversible such that the shuttle motor 82 is operable to reverse the direction of reciprocal motion of the shuttle 78. The shuttle motor 82 may be a direct current (DC) motor, for example. The shuttle motor 82 preferably rotates its shuttle motor output shaft 86 when activated at a rotational speed corresponding to its input power level and stops rotating when de-activated.

Figure 14:
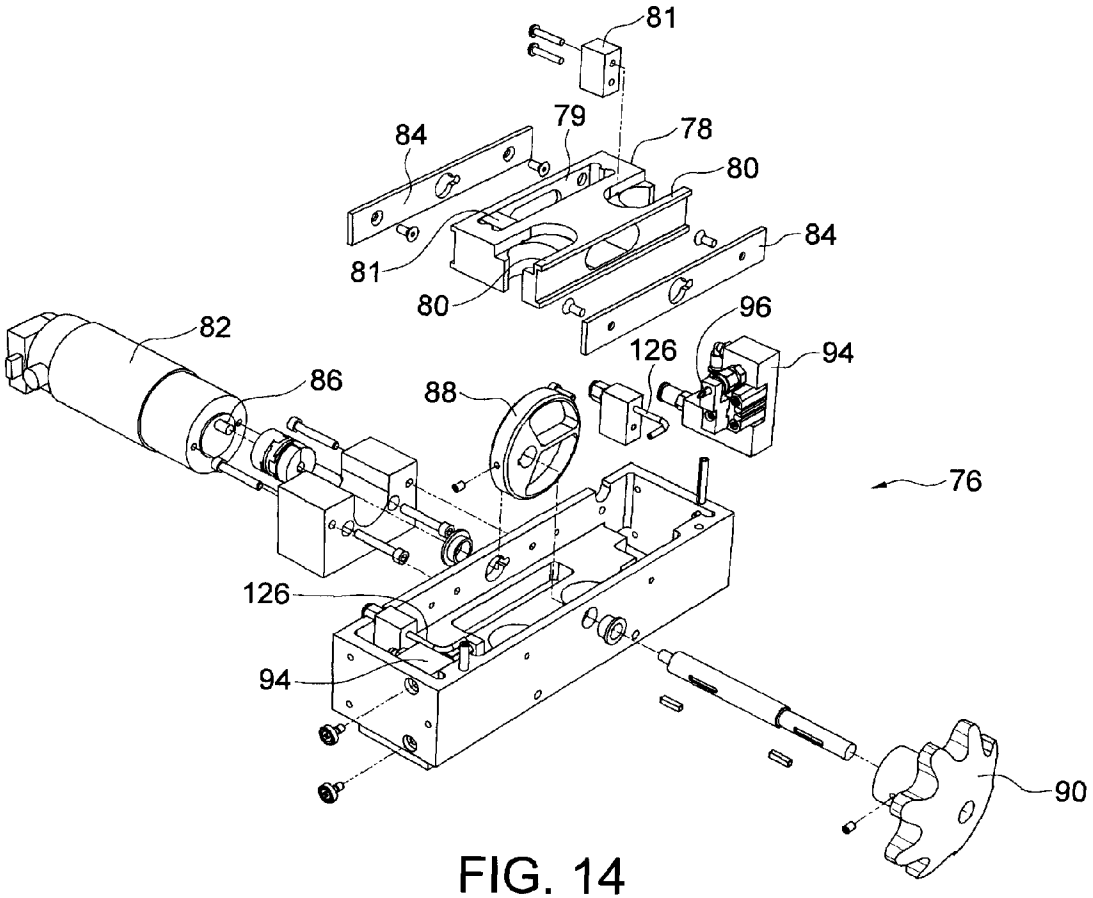
FIG. 14 is an exploded perspective view of an injector of the apparatus shown in FIG. 1.
Figure 15:
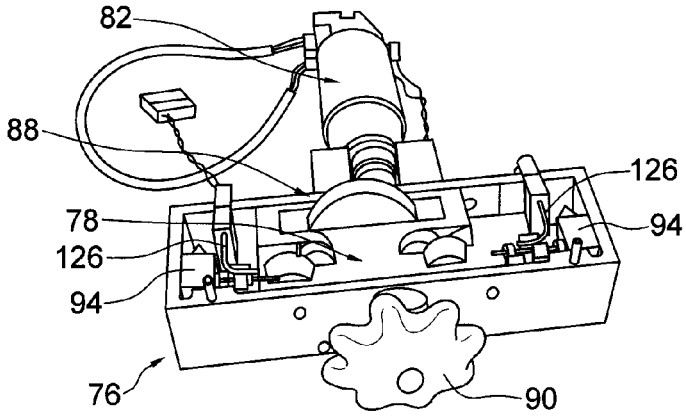
FIG. 15 is a perspective view of the injector shown in FIG. 14.
Figure 16:
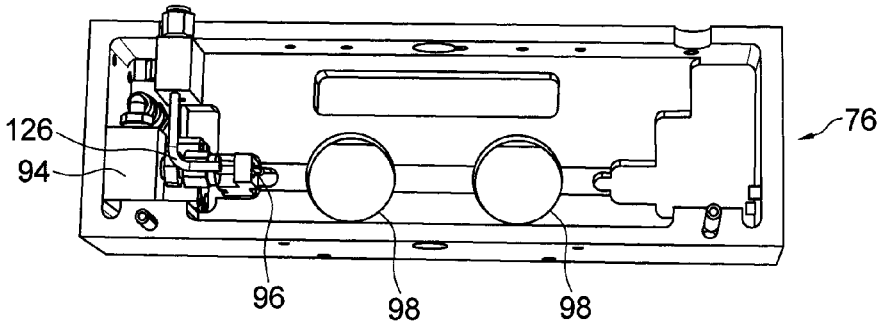
FIG. 16 is a top view of a portion of the injector shown in FIG. 14, showing injector exits.
Figure 17:
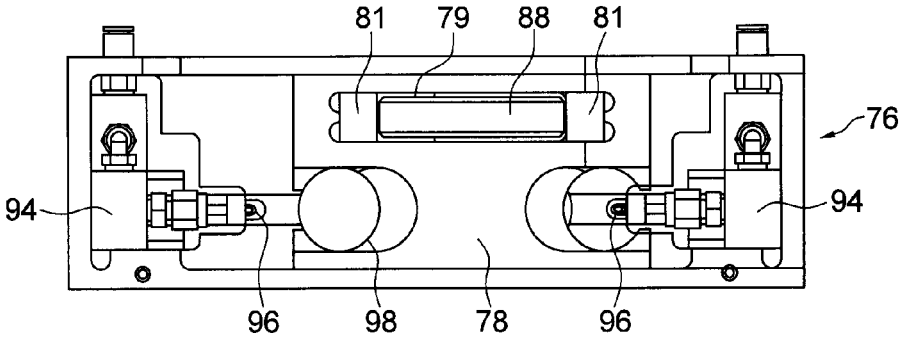
FIG. 17 is a top view of a portion of the injector shown in FIG. 14, showing injector pumps.

The shuttle motor 82 may be operable to produce one or more signals associated with the completion of a constant number or fraction of revolutions of the shuttle motor output shaft 86, the instantaneous or average rotational speed of the shuttle motor output shaft 86, the power consumption of the shuttle motor 82, the power output of the shuttle motor 82, and any combination thereof. A hand wheel 90 may be connected to the shuttle motor output shaft 86 opposite the shuttle motor 82 such that the shuttle 78 may be manually reciprocated. In some embodiments, the hand wheel 90 is indirectly connected to the shuttle motor output shaft 86 via a coupling unit and a main driveshaft, as shown in FIG. 14 for example. The provision of the hand wheel 90 advantageously permits manual clearing of a jammed condition, for example.

Referring back to FIG. 4, the shuttle motor 82 in some embodiments receives isolated input power, such as by receiving its input power via an isolation relay 92. FIG. 4 shows the isolation relay 92 mounted on the main circuit board 170 for providing an electrical connection between the shuttle motor 82 and other components mounted on the main circuit board 170. However, in general the isolation relay 92 may be mounted to the shuttle motor 82, connected adjacent the shuttle motor 82 or located anywhere in or on the apparatus 10, for example. The isolation relay 92 maintains an electrical connection between circuitry of the main circuit board 170 and the shuttle motor 82 whenever the main power of the apparatus 10 is available, such as by permitting the main power of the apparatus 10 to energize a relay coil of the isolation relay 92. The isolation relay 92 prevents any electrical energy generated by the shuttle motor 82 during manual operation of the shuttle 78 from appearing at other components of the main circuit board 170 when the main power of the apparatus 10 has failed or is otherwise disconnected, thereby advantageously preventing circuitry of the main circuit board 170 from incorrectly registering main power when such main power is in fact disconnected.

Referring again to FIGS. 14 to 17, reactant pumps 94 are located at opposing ends of the injector 76 such that when the shuttle 78 is at an extreme end of its reciprocating motion, an injector needle 96 of one reactant pump 94 is positioned to pierce a projectile 14 located in the correspondingly proximate shuttle receptacle 80. Each injector needle 96 is operatively coupled to its corresponding reactant pump 94 such that an amount of reactant is injected into the projectile 14 when the injector needle 96 is inserted within the projectile 14. The reactant pump 94 is preferably of the constant displacement pump type such that a specifiable fixed amount of reactant is injected into each projectile 14, regardless of the reciprocating speed of the shuttle 78. The constant displacement nature of the reactant pump 94 advantageously permits an optimal amount of reactant to be injected into each projectile 14 independently of the speed at which the shuttle 78 is reciprocating.

The reciprocating movement of the shuttle 78 permits the shuttle 78 to receive a projectile 14 at one shuttle receptacle 80 in substantial alignment with the corresponding hopper exit 28, move the received projectile 14 toward the injector needle 96 where the projectile 14 is injected with a reactant, move the received projectile away from the injector needle 96 to a position where the shuttle receptacle is in substantial alignment with its associated injector exit 98 (see FIG. 16 for example) with the dispenser chute 16 such that the injected projectile 14 is dispensed through the dispenser chute 16 and expelled from the aircraft. A time delay (depending on the incendiary material and selected reactant) after the projectile 14 has been injected, the projectile 14 will ignite, thereby causing burning.

The mechanical arrangement of components described herein and shown in the Figures advantageously permits the placement of the gate pins 46 in close proximity to the shuttle receptacles 80, thereby advantageously minimizing the number of projectiles 14 between the dispenser gate 42 and the shuttle 78. Also, the apparatus 10 is advantageously dimensioned to minimize the gate-to-shuttle distance between each gate pin 46 and its corresponding shuttle receptacle 80. In the first embodiment, the gate-to-shuttle distance is preferably such that a maximum of one projectiles 14 fits between the gate pins 46 and the shuttle 78. For example, the distance between each gate pin 46 and the entry of its corresponding shuttle receptacle 80 may be ⅛ (one-eighth) of an inch less than the diameter of the projectiles 14 typically used with the apparatus 10, including being 0.875 inches.

Figure 18:
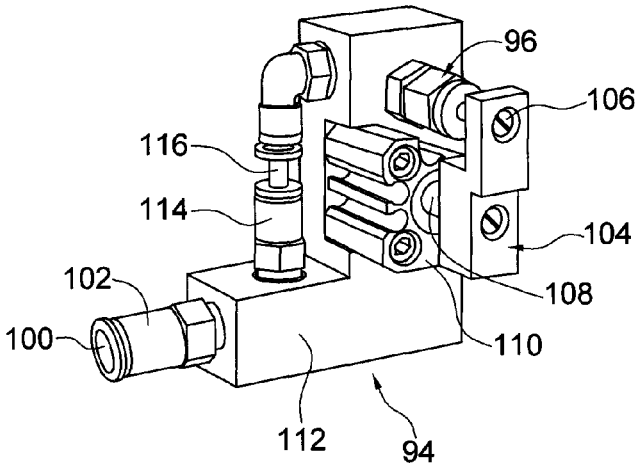
FIG. 18 is a perspective view of one of the injector pumps shown in FIG. 17.
Figure 19:
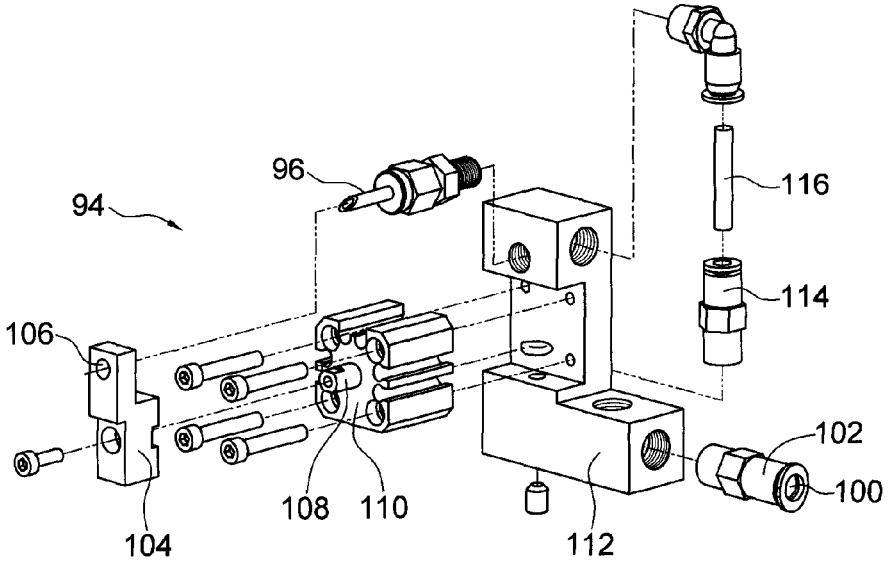
FIG. 19 is an exploded perspective view of the injector pump shown in FIG. 18.

Referring to FIGS. 18 to 19, the reactant pump 94 preferably includes a reactant inlet 100 for receiving reactant and a reactant inlet valve 102 attached to the reactant inlet 100. The reactant inlet valve 102 is preferably of the non-return type such that it permits reactant to be received into the reactant pump 94 without permitting reactant to flow outwardly from the reactant pump 94. Reactant may flow outwardly from the reactant pump 94 via the injector needle 96.

The injector needle 96 projects through a pump arm 104 at a needle aperture 106 of the pump arm 104. The pump arm 104 is attached to a pump piston 108. The pump arm 104 and the pump piston 108 are slidably coupled via a pump cylinder 110 to a pump manifold block 112, which is fixed to the injector 76. When the shuttle 78 is near the extreme end of its reciprocating motion, any projectile 14 in the shuttle receptacle 80 proximate the reactant pump 94 is operable to slide the pump arm 104 and the pump piston 108 toward the pump manifold block 112. The extent of movement of the pump piston 108 is determined by the stroke length of the reciprocating path of the shuttle 78 and is independent of the reciprocating speed of the shuttle 78. In this manner, the pump piston 108 slides a substantially constant distance within the pump cylinder 110 for each injection.

The pump piston 108 is in fluid communication with a reactant outlet valve 114 via a reactant channel (not visible in FIGS. 18 and 19) within the pump manifold block 112. The reactant outlet valve 114 is preferably of the non-return type such that it permits reactant to flow outwardly from the reactant pump 94 without permitting reactant to flow inwardly toward the reactant pump 94. The reactant outlet valve 114 is in fluid communication via an outlet reactant channel, such as the tubing 116 shown in FIGS. 18 to 19, with the injector needle 96. The reactant pump 94 is operable to cause reactant to flow outwardly through the reactant outlet valve 114 and the injector needle 96 when the pump piston 108 moves toward the pump manifold block 112. When the pump piston 108 displaces toward the reactant outlet valve 114, a specifiable volume of reactant flows outwardly through the reactant outlet valve 114.

The volume of reactant that flows outwardly from the reactant pump 94 is determined by the extent of movement of the pump piston 108 toward the pump manifold block 112 and the dimensions of the pump piston 108 and the pump cylinder 110, and is independent of the speed of movement of the pump piston 108. The extent of movement of the pump piston 108 is determined by the dimensions of the injector 76, including the stroke length of the shuttle 78 and the size of the projectiles 14, and is independent of the reciprocating speed of the shuttle 78. When the shuttle 78 is proximate the pump manifold block 112, the injector needle 96 is typically piercing a projectile 14 located within the proximate shuttle receptacle 80 and the reactant flowing outwardly through the injector needle 96 is injected into the projectile 14.

The pump piston 108 is in fluid communication with a reactant channel within the pump manifold block 112 such that movement of the pump piston 108 away from the pump manifold block 112 causes reactant to enter the pump manifold block 112 from the reactant inlet 100 via the reactant inlet valve 102. In this manner, reactant is stored within the pump manifold body 112 between the reactant inlet valve 102 and the reactant outlet valve 114 when the pump piston 108 is displaced from the pump manifold block 112. The stored reactant is suitable for flowing outwardly from the reactant pump 94 via the injector needle 96 when the shuttle 78 returns at the next reciprocal cycle of the shuttle 78.

Still referring to FIGS. 18 to 19, when the shuttle 78 moves away from the pump manifold block 112 (toward the opposing pump manifold block 112), the shuttle 78 in some embodiments pulls the pump arm 104 and with it the pump piston 108 away from the pump manifold block 112, thereby causing reactant to enter the pump manifold block 112 via the reactant inlet valve 102. Additionally or alternatively, fluid pressure of reactant at the reactant inlet 100 may push the pump piston 108 away from the pump manifold block 112 when the shuttle 78 has is not providing an opposing force. Additionally or alternatively, the pump piston 108 and/or the pump arm 104 may be resiliently coupled to the pump manifold block 112 such that the pump piston 108 is urged away from the pump manifold block 112. For example, the pump piston 108 is preferably spring-loaded against the force provided by the shuttle 78 when it is proximate to the pump manifold block 112.

Referring back to FIGS. 1 to 4, the container assembly 36 includes a reactant tank 118 for storing reactant. The reactant tank 118 is in fluid communication with the reactant inlet 100 for providing reactant to the reactant pump 94. An operator may remove the reactant tank cap 120 to add reactant to the reactant tank 118. In some embodiments, the reactant tank 118 contains therein a reactant level sensor (not shown) for indicating the level or amount of reactant in the reactant tank 118. The reactant level sensor may be operable to produce an analog electrical output, a digital electronic output, or any combination thereof, for example.

Still referring to FIGS. 1 to 4, the container assembly 36 also includes a fire extinguisher tank 122 for storing extinguishing agent, such as water for example. The extinguisher tank 122 preferably has inserted therein a fluid level sensor (not shown) for sensing the level of extinguishing agent in the extinguisher tank 122. In some embodiments, the fluid sensor produces an analog electrical output. Additionally or alternatively, the fluid sensor may produce a digital output. In the first embodiment, the fluid sensor is operable to connect and disconnect an electrical connection in accordance with the fluid level. The fluid sensor may be implemented as a normally closed switch, for example. An operator may remove the fire extinguisher tank cap 124 to add extinguishing agent to the fire extinguisher tank 122. The fire extinguisher tank 122 is in fluid communication with one or more extinguisher nozzles 126 (FIGS. 14 to 16) located in the injector 76 such that fires within the apparatus 10 may be extinguished. A fire extinguisher pump (not shown) preferably provides fluid pressure to supply the extinguishing agent at a sufficient rate for fire extinguishing. The fire extinguisher pump is preferably electrically powered. The fire extinguisher pump may be powered by alternating current (AC) or DC power, including being powered by pulse-width-modulation techniques. In some embodiments, the fire extinguisher pump is mechanically operated. In the first embodiment, the fire extinguisher pump is powered by DC power. One or more extinguisher batteries 128 are shown through the cut-out in FIG. 4. In the first embodiment, the extinguisher batteries 128 are rechargeable and are maintained in their charged state when electrical power is supplied to the apparatus 10. In the first embodiment, one 12-volt rechargeable extinguisher battery 128 is employed. The extinguisher batteries 128 are advantageously operable to supply power to the fire extinguisher pump (not shown) when the primary power source of the fire extinguisher pump has failed or is otherwise disconnected.

Still referring to FIGS. 1 to 4, a main panel 130 is shown. In the first embodiment, the main panel 130 includes a display 132, a power indicator 134, a motor fault indicator 136, a low extinguishing agent indicator 138, a RUN/STOP switch 140, a RUN/STOP indicator 142, a count reset switch 144, a jog switch 146 and a fire extinguisher pump switch 148.

Connected to the apparatus 10 is a remote panel 150, which in the first embodiment is in electrical communication with the container assembly 36 via an electrical cable 152. Additionally or alternatively, wireless communication techniques may be used for communication between the remote panel and the remainder of the apparatus 10. The length and electrical ratings of the electrical cable 152 may be optimally selected for use of the apparatus 10 within the aircraft. The length of the electrical cable 152 may be about 4 feet (1.22 meters) and may be between 1 feet (30 cm) and 10 feet (3.0 m), for example. The remote panel 150 may be powered using the main power to the apparatus 10 or may be separately powered.

The remote panel 150 in the first embodiment includes a remote power indicator 154, a remote RUN indicator 156, a remote fault indicator 158, a remote feed gate switch 160, and a remote speed control switch 162.

In some embodiments, one or more switches of the apparatus 10 are safe guarded against unintentional actuation. For example, the apparatus 10 preferably includes a switch guard for each of one or more switches of the apparatus 10. As shown in FIG. 4, the apparatus 10 preferably includes the RUN/STOP switch guard 164 for the RUN/STOP switch 140, the fire extinguisher pump switch guard 166 for the fire extinguisher pump switch 148, and the remote feed gate switch guard 168 for the remote feed gate switch 160. FIG. 4 shows the switch guards 164, 166 and 168 as pairs of generally U-shaped bars attached to either side of each switch to be guarded. However, other shapes, sizes and forms of switch guards operable to prevent unintentional actuation are possible and are contemplated as being within the scope of the present invention.

The display 132 is preferably a light-emitting diode (LED) display, and may be a numeric LED display comprising one or more LED segments. However, the display 132 may be a liquid crystal display (LCD) or other suitable display. Each of the power indicator 134, motor fault indicator 136, low extinguishing agent indicator 138, RUN/STOP indicator 142, remote power indicator 154, remote RUN indicator 156 and the remote fault indicator 158 may be a LED or other suitable indicator. Different indicators may be differently provided. Preferably, the remote feed gate switch 160 is a three-position momentary switch having a neutral position to which the remote feed gate switch 160 is urged towards, an open position for opening the dispenser gate 42 and a close position for closing the dispenser gate 42. In the first embodiment, when the remote feed gate switch 160 is released from either the open position or the close position, the remote feed gate switch 160 returns to its neutral position.

Referring to FIGS. 1 to 4, the controller for regulating the operation of the apparatus 10, which includes the main circuit board 170 (FIG. 4), also includes a processing circuit 172 and a memory circuit 174.

The processing circuit 172 is operable to receive one or more inputs and perform computational operations on the received inputs to produce one or more outputs. The processing circuit 172 is preferably a digital processing circuit comprising one or more circuit units, such as a central processing unit (CPU), operating independently or in parallel, including operating redundantly. The processing circuit 172 may be implemented by one or more integrated circuits (IC), including being implemented by a single monolithic integrated circuit (MIC). Additionally or alternatively, the processing circuit 172 may be implemented as a programmable logic controller (PLC), for example. The processing circuit 172 is preferably operable to implement multi-tasking methods involving multiple threads of executable code. The processing circuit 172 may include circuitry for storing memory, such as digital data, and may comprise the memory circuit 174.

The main circuit board 170 preferably includes a battery charger (not shown) for charging the one or more extinguisher batteries 128.

The memory circuit 174 is operable to store information, including instructions for computational operations to be performed by the processing circuit 172. The memory circuit 174 is preferably operable to store digital data, including storing digital codes directing the processing circuit 172 to perform one or more methods. The memory circuit 174 may be implemented by one or more integrated circuits (IC), including being implemented by a single monolithic integrated circuit (MIC). The memory circuit may be implemented as Random Access Memory (RAM), Read-Only Memory (ROM), Programmable Read-Only Memory (PROM), Erasable Programmable Read-Only Memory (EPROM), Electrically Erasable Programmable Read-Only Memory (EEPROM), flash memory, one or more flash drives, Universal Serial Bus (USB) connected memory units, magnetic storage disks, optical disks, and any combination thereof, for example. The memory circuit 174 may be operable to store memory as volatile memory, non-volatile memory, dynamic memory, and any combination thereof.

Controller Operation

Figure 20:
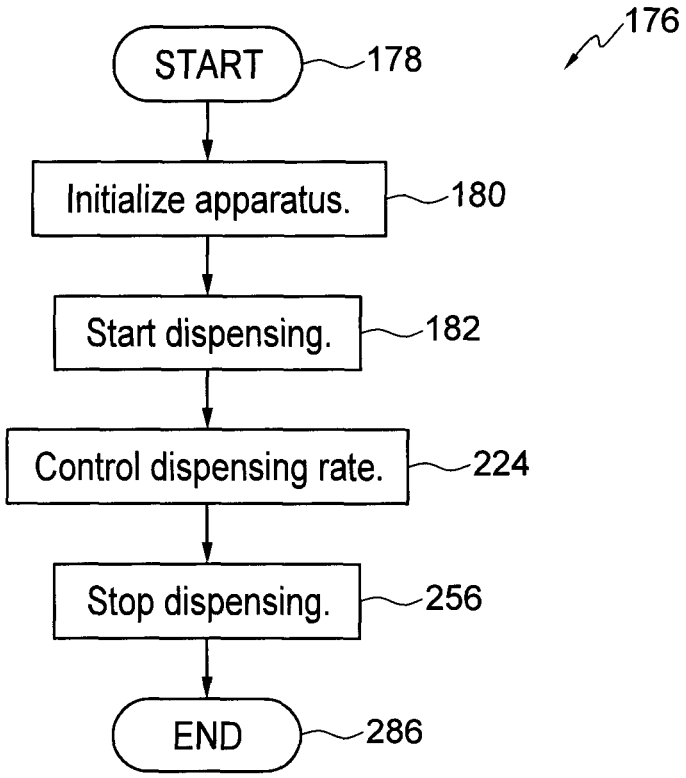
FIG. 20 is a flow diagram of a method of operation of a controller having components shown in FIG. 4.

Referring to FIG. 20, the memory circuit 174 in accordance with the first embodiment of the present invention contains blocks of code for directing the processing circuit 172 to perform a method shown generally at 176. When electrical power is supplied to the processing circuit 172 and the memory circuit 174, such as by supplying power to the apparatus 10, the processing circuit 172 is directed to begin processing at block 178. Block 180 then directs the processing circuit 172 to initialize the controller.

Initializing the controller may include performing internal data integrity and processing checks; activating all output indicators for a specified amount of time; receiving input, including receiving input from the fluid level sensor (not shown) of the extinguisher tank 122 and receiving input from apparatus 10 switches; setting memory values, including possibly memory flags, within the memory circuit 174 in accordance with values of received input; determining states associated with one or more apparatus 10 output indicators, activating selected apparatus 10 output indicators; de-activating selected apparatus 10 output indicators; producing an output to close the dispenser gate 42; producing an output to de-activate the hopper motor 24; producing an output to activate the hopper motor 24; producing an output to de-activate the shuttle motor 82; any combination thereof, for example. Activating an indicator may include illuminating a light source of the indicator, including intermittently illuminating the light source to cause the indicator to flash and steadily illuminating the light source to cause the indicator to be activated and steady.

After block 180 has been executed in the case where the RUN/STOP switch 140 is set to STOP and under normal conditions, the apparatus 10 is preferably initialized such that the hopper motor 24 is not operating, the shuttle motor 82 is not operating, the dispenser gate 42 is closed, the power indicator 134 and the remote power indicator 154 are activated and steady, the motor fault indicator 136 is de-activated, the low extinguishing agent indicator 138 is de-activated, the RUN/STOP indicator 142 is de-activated, the remote RUN indicator 156 is de-activated and the remote fault indicator 158 is de-activated.

After block 180 has been executed, block 182 then directs the processing circuit 172 to perform a method in which dispensing of any projectiles 14 present in the hopper 18 is started upon appropriate user input conditions.

Figure 21:
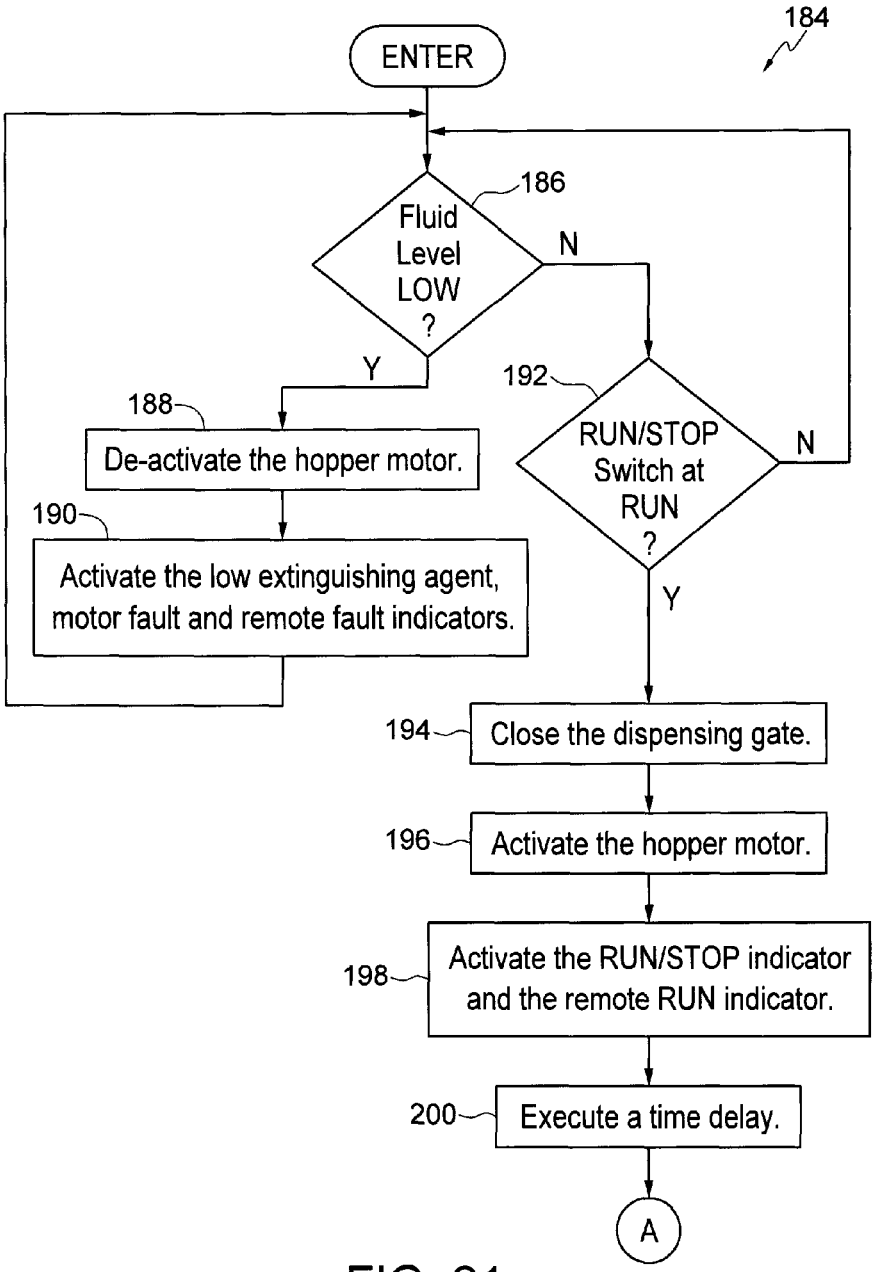
FIG. 21 is a flow diagram of steps of a starting dispensing method shown in FIG. 20.
Figure 22:
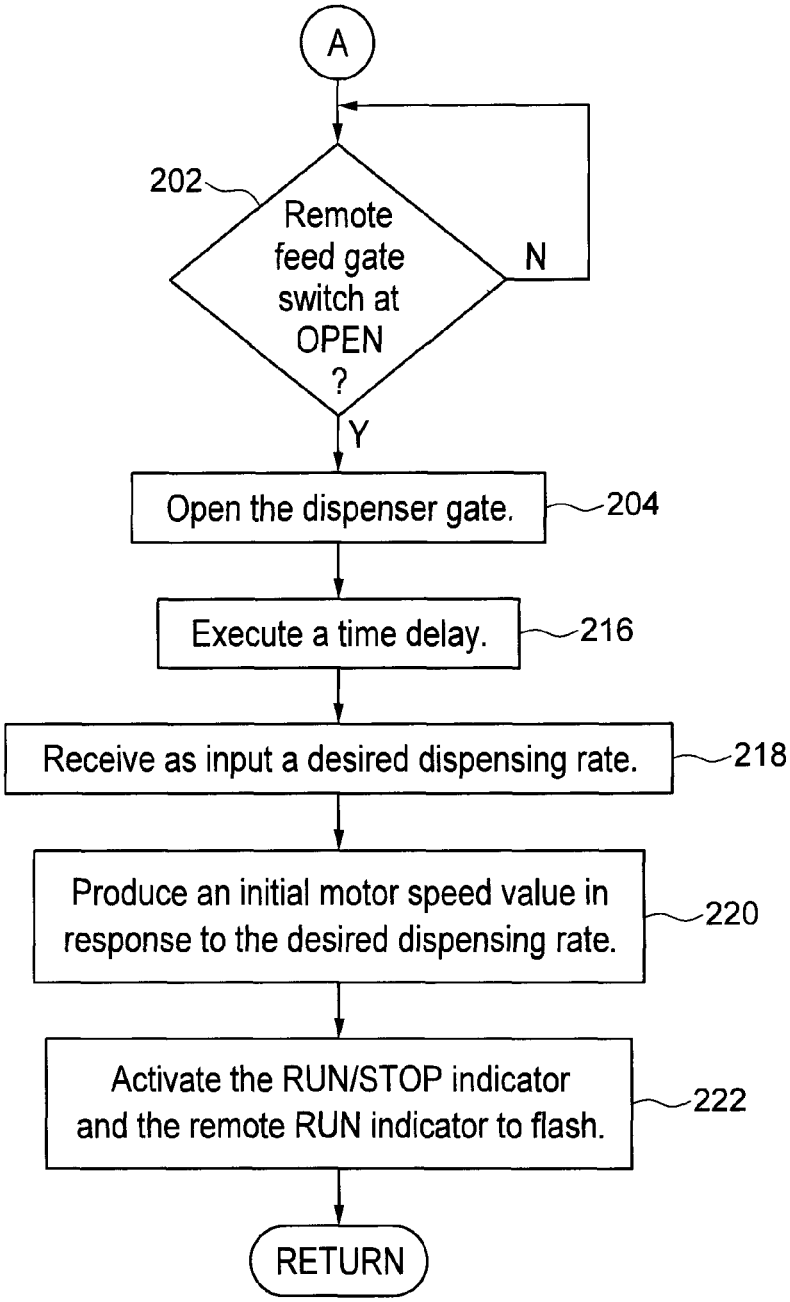
FIG. 22 is a flow diagram of concluding steps of the starting dispensing method illustrated in FIG. 21.

Referring to FIGS. 21 and 22, a method for starting to dispense the projectiles 14 in accordance with block 182 (FIG. 20) is shown generally at 184. Block 186 (FIG. 21) directs the processing circuit 172 to determine whether the fluid level in the fire extinguisher tank 122 is low. The processing circuit 172 is preferably operable to receive as input an indication of the fluid level in the fire extinguisher tank 122 from the fluid level sensor (not shown), and to determine whether the fluid level is low. If the processing circuit 172 determines that the fluid level is low, then the processing circuit 172 is directed to execute block 188.

Block 188 directs the processing circuit 172 to assign a value to a hopper motor flag within the memory circuit 174, such that the hopper motor 24 remains or becomes de-activated.

Block 190 then directs the processing circuit 172 to assign value to flags in the memory circuit 174 associated with the low extinguishing agent indicator 138, the motor fault indicator 136 and the remote fault indicator 158 such that the indicators 138, 136 and 158 are activated. After block 190 is executed, the processing circuit 172 is directed to return to execute block 186.

The apparatus 10 is preferably operable to prevent the start of dispensing of projectiles 14 if the level of extinguishing agent in the fire extinguisher tank 122 is insufficient, thereby advantageously providing a safety feature. The execution of blocks 186, 188 and 190 of the first embodiment implements this safety feature. Additionally or alternatively, the method 176 may include processing steps to permit the hopper motor 24 to be activated, but prevent the shuttle motor 82 from being activated, when the fluid level of the fire extinguisher tank 122 is low. Additionally or alternatively, the method 176 may include processing steps to permit the hopper motor 24 and the shuttle motor 82 to be activated, but to close the dispenser gate 42 and prevent the dispenser gate 42 from being opened.

In addition to the execution of blocks 186 to 190, the apparatus 10 is preferably operable to activate and de-activate the low extinguishing agent indicator 138 in accordance with the output of the fluid level sensor (not shown), including in accordance with the value of an associated flag in the memory circuit 174. A polling method may be implemented to regulate the low extinguishing agent indicator 138, for example. Additionally or alternatively, an interrupt type method may be implemented such that the processing circuit 172 is operable to receive input from the fluid sensor (not shown) at any time the fluid sensor produces an output indicating a significant change in fluid level. The apparatus 10 is preferably operable to delay toggling activation of the low extinguishing agent level 138 after the fluid level has remained at a new level for a specifiable period of time, such as a time period in the range of 1 to 5 seconds, including a time period of 2 seconds. Such time delay advantageously reduces the effect of sloshing of fluid within the fire extinguisher tank 122 on the indication of fluid level by the low extinguishing agent level 138. The apparatus 10 is preferably operable to permit the continued dispensing of projectiles 14 when the fluid level of the fire extinguisher tank 122 is low, provided the fluid level was not low when dispensing commenced. In some embodiments, the apparatus 10 is operable to stop dispensing projectiles 14 after the fluid level of the fire extinguisher tank 122 becomes low.

Still referring to FIG. 21, if at block 186 the processing circuit 172 determines that the fluid level of the fire extinguisher tank 122 is not low, then the processing circuit 172 is directed to execute block 192.

Block 192 directs the processing circuit 172 to determine whether the RUN/STOP switch 140 is set to its RUN position.

If the processing circuit 172 determines that the RUN/STOP switch 140 is not set to its RUN position (i.e. set to its STOP position), then processing returns to block 186. If the processing circuit 172 determines that the RUN/STOP switch 140 is set to its RUN position, then the processing circuit 172 is directed to execute block 194. Block 194 directs the processing circuit 172 to close the dispenser gate 42.

Figure 27:
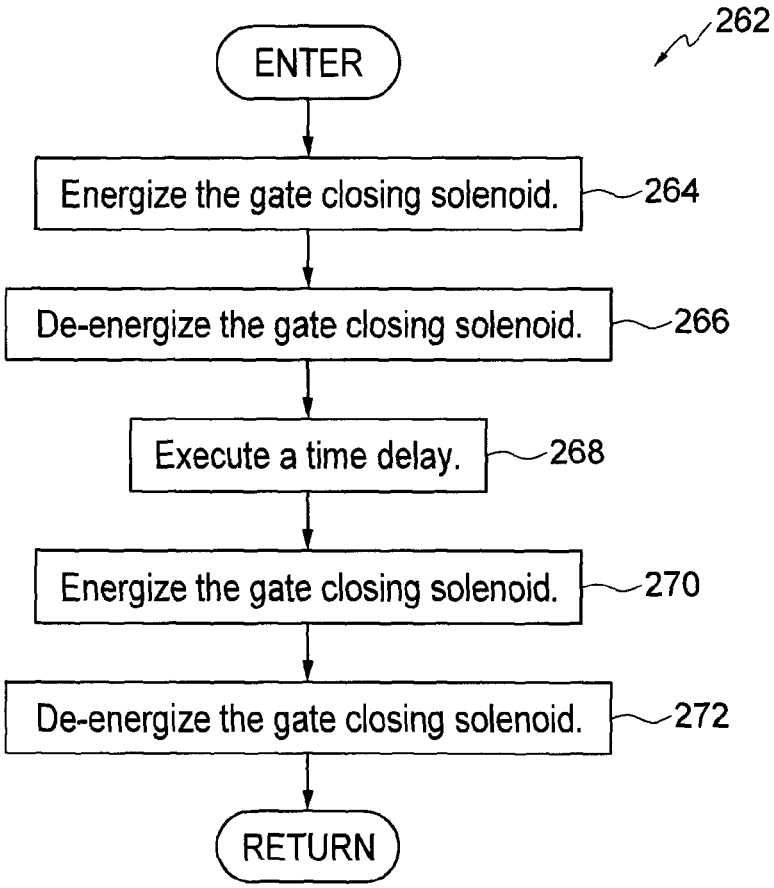
FIG. 27 is a flow diagram of a dispensing gate closing method shown in FIG. 26.

Referring to FIG. 27, a method for closing the dispenser gate 42 in accordance with block 194 (FIG. 21) is shown generally at 262. Block 264 directs the processing circuit 172 to assign a value to a gate closing solenoid flag within the memory circuit 174 such that the gate closing solenoid 68 is activated. Activating the gate closing solenoid 68 causes the gate pins 46 to extend to block the gate passages 44. When sufficient time has elapsed to permit the gate pins 46 to fully extend, then the process proceeds to block 266, which directs the processing circuit 172 to assign a new value to the gate closing solenoid flag within the memory circuit 174 such that the gate closing solenoid 68 is de-activated.

Block 268 then directs the processing circuit 172 to wait during the elapse of a time delay before continuing. The time delay of block 268 is preferably dependent on the dispensing rate of the apparatus 10. The processing circuit 172 may determine the time delay of block 268 from a look-up table stored in the memory circuit 174 specifying the appropriate time delay for each possible desired dispensing rate, for example.

Block 270 then directs the processing circuit 172 to assign a value to a gate closing solenoid flag within the memory circuit 174 such that the gate closing solenoid 68 is activated. The processing circuit 172 may execute block 270 similarly, analogously or identically to block 264. When sufficient time has elapsed to permit the gate pins 46 to fully extend, then the process proceeds to block 272, which directs the processing circuit 172 to assign a new value to the gate closing solenoid flag within the memory circuit 174 such that the gate closing solenoid 68 is de-activated.

Still referring to FIG. 27, the apparatus 10 is advantageously operable to minimize the likelihood of a given gate pin 46 undesirably remaining in its retracted position after unsuccessfully attempting to fully extend, such as when the given gate pin 46 strikes and jams against a projectile 14 while extending such that the given gate pin 46 does not lock into place in its fully extended position. In such a case, the apparatus 10 is operable to wait an appropriate length of time while the gate pin 46 retracts and the struck projectile 14 travels through the gate passage 44 a sufficient distance such that the given gate pin 46 can fully extend without risk of jamming against either the struck projectile 14 or a subsequently following projectile 44. The apparatus 10 is operable to vary the appropriate length of time in response to the expected velocity of the projectiles 14 based on the desired dispensing rate. When the block 272 has been executed, the processing circuit 172 is then directed to return to execute block 196 shown in FIG. 21.

Block 196 directs the processing circuit 172 to assign a value to the hopper motor flag within the memory circuit 174, such that the hopper motor 24 is or becomes activated. Block 198 then directs the processing circuit 172 to assign values to flags associated with the RUN/STOP indicator 142 and the remote RUN indicator 156 such that these indicators 142 and 156 are activated and steady. Block 200 then directs the processing circuit 172 to wait during the elapse of a time delay before continuing. The apparatus 10 is advantageously operable to prevent the opening of the dispenser gate 42 immediately following the activation of the hopper motor 24, thereby providing sufficient time for agitating projectiles 14 in the hopper 18 to form a suitable queue of projectiles 14 available to exit the hopper 18. In this manner, the likelihood of a jammed condition within the apparatus 10 is minimized. The time delay of block 200 is preferably between 1 and 3 seconds in duration.

The blocks 194, 196, 198 and 200 may be executed in any order. The time delay of block 200 may include or exclude any processing time associated with executing blocks 194, 196 and 198. When blocks 194, 196, 198 and 200 have been executed, the processing circuit 172 is directed to return to execute block 202.

Referring to FIG. 22, block 202 directs the processing circuit 172 to determine whether the remote feed gate switch 160 is being set to its OPEN position. If the processing circuit 172 determines that the remote feed gate switch 160 is not being set to its OPEN position, then processing returns to the start of block 202. If the processing circuit 172 determines that the remote feed gate switch 160 is being set to its OPEN position, then the processing circuit 172 is directed to execute block 204.

Block 204 directs the processing circuit 172 to execute a method such that the dispenser gate 42 becomes opened.

Figure 23:
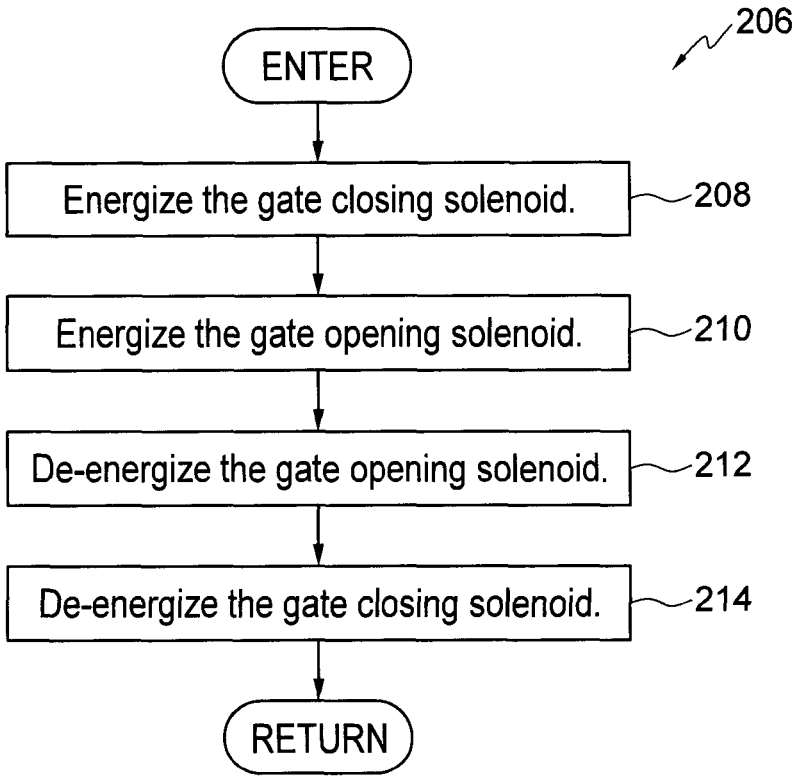
FIG. 23 is a flow diagram of steps of a dispenser gate opening method shown in FIG. 22.

Referring to FIG. 23, a method for opening the dispenser gate 42 in accordance with block 202 (FIG. 22) is shown generally at 206. Block 208 directs the processing circuit 172 to assign a value to a gate closing solenoid flag within the memory circuit 174 such that the gate closing solenoid 68 is activated. The execution of block 208 advantageously releases any lateral force exerted by the gate pins 46 on the gate locking pins 66, thereby facilitating retraction of the gate locking pins 66. Block 210 then directs the processing circuit 172 to assign a value to a gate opening solenoid flag within the memory circuit 174 such that the gate opening solenoid 74 is activated. The execution of block 210 results in the retraction of the gate locking pins 66 such that the gate pins 46 are released from their locked conditions. Blocks 212 and 214 direct the processing circuit 172 to assign new values to the gate opening solenoid flag and the gate closing solenoid flag such that the gate opening solenoid 74 and the gate closing solenoid 68 are de-energized, respectively. The execution of block 214 results in the retraction of the gate pins 46 under the force of resilient urging. Blocks 212 and 214 may be suitably executed in the opposite order from that shown in FIG. 23. Although not shown in FIG. 23, the processing circuit 172 may execute time delays between executing blocks 208 to 214 to provide sufficient time for associated movement of mechanical components of the apparatus 10. After blocks 212 and 214 have been executed, the processing circuit 172 is directed to return to execute block 216 shown in FIG. 22.

Referring back to FIG. 22, block 216 directs the processing circuit 172 to wait during the elapse of a time delay before continuing. The apparatus 10 is advantageously operable to prevent the shuttle motor 82 from operating immediately following the opening of the dispenser gate 42, thereby providing sufficient time for an initial set of projectiles 14 to pass through the hopper exits 28 and arrive at the shuttle receptacles 80 before the shuttle 78 begins reciprocating. In this manner, the likelihood of a jammed condition within the apparatus 10 is minimized. The time delay of block 216 is preferably between 0.1 and 2 seconds, including being about 0.5 seconds. When block 216 has been executed, the processor circuit 172 is directed to execute block 218.

Block 218 directs the processing circuit 172 to receive as input a value associated with the current position of the remote speed control switch 162, and assigning that value, or an associated value calculated therefrom, to the desired dispensing rate, which is preferably stored within the memory circuit 174.

Block 220 then directs the processing circuit 172 to determine and assign a value for an initial shuttle motor 82 speed in response to the desired dispensing rate. The apparatus 10 is operable to activate and supply electrical power to the shuttle motor 82 in accordance with the initial shuttle motor 82 speed value. Preferably, the initial shuttle motor 82 speed value is limited to a maximum initial value such that an initial maximum level of electrical power supplied to the shuttle motor 82 is not exceeded during an initial phase of operation of the shuttle motor 82. The apparatus 10 is preferably operable to limit the momentum attainable by the shuttle 78 immediately upon startup for a specifiable duration of time, thereby advantageously minimizing the likelihood of a jammed condition of the apparatus 10. The duration of the initial phase is preferably between 0.5 and 10 seconds, including being between 1 and 2 seconds. The duration may be 1.5 seconds, for example. Although not shown in FIG. 22, the method of the present invention preferably includes releasing the initial limit on the shuttle motor 82 speed value after the elapse of the duration of the initial phase. In the first embodiment in which the initial shuttle motor 82 speed value relates to a duty cycle of a pulse-width modulated output of the processing circuit 172, the maximum initial value is preferably selected to relate to a duty cycle between 10 percent and 90 percent, including relating to a duty cycle of about 25 percent.

Block 222 then directs the processing circuit 172 to assign values to flags in the memory circuit 174 associated with the RUN/STOP indicator 142 and the remote RUN indicator 156 such that these indicators 142 and 156 are periodically activated, thereby producing the effect of flashing the indicators 142 and 156.

Block 216 may be executed before, during or after the execution of blocks 218 to 222. Block 222 may be executed before, during or after the execution of blocks 216 to 220. The time delay of block 216 may include or exclude any processing time associated with executing blocks 218 to 222. When blocks 216 to 222 have been executed, the processing circuit 172 is directed to return to execute block 224 of FIG. 20.

Referring back to FIG. 20, block 224 directs the processing circuit 172 to execute a method of controlling the dispensing rate of the apparatus 10.

Figure 24:
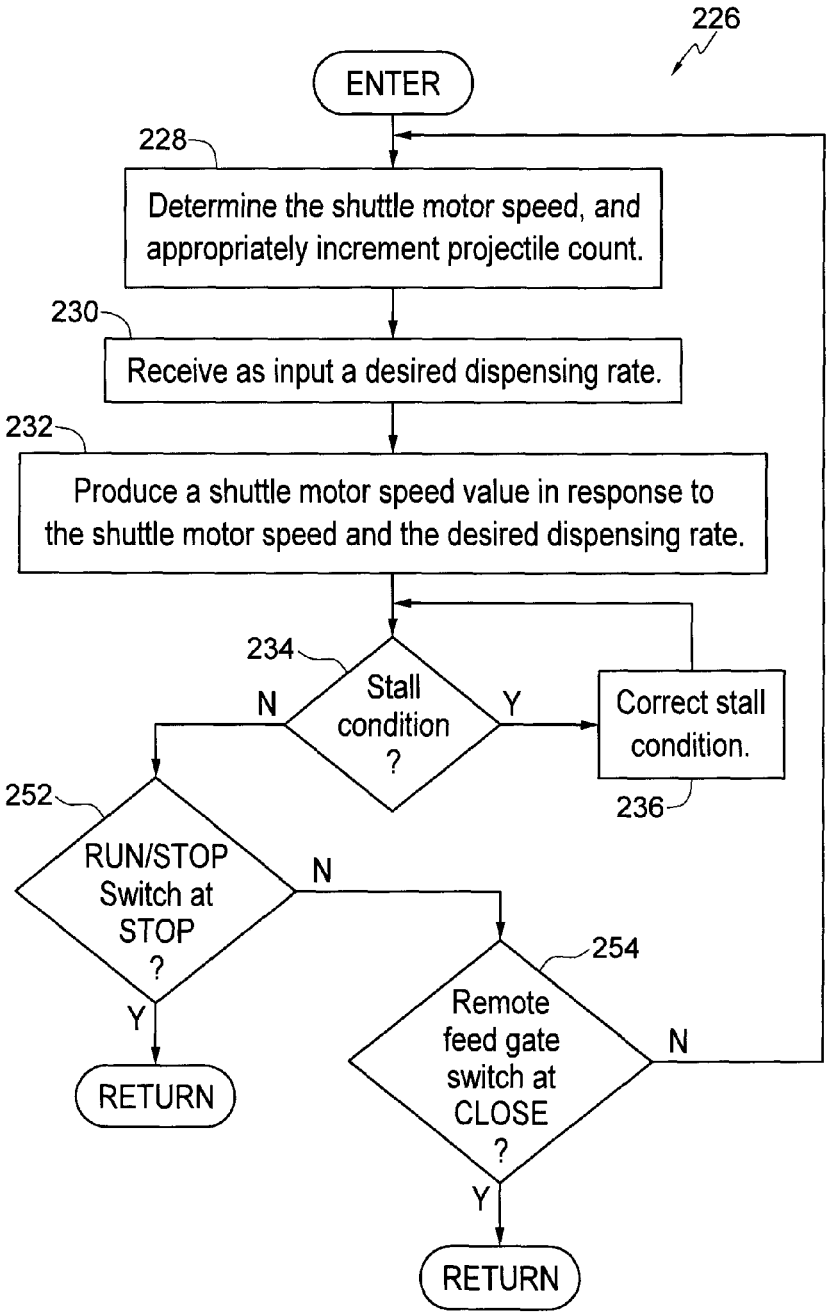
FIG. 24 is a flow diagram of steps of a dispenser rate controlling method shown in FIG. 20.

Referring to FIG. 24, a method for controlling the dispensing rate in accordance with block 224 (FIG. 20) is shown generally at 226. Block 228 directs the processing circuit 172 to determine the shuttle motor 82 speed. The processing circuit 172 may be operable to receive as input a value associated with the current actual shuttle motor 82 speed. The processing circuit 172 may receive such input from the shuttle motor 82, directly by an electrical connection or indirectly via signal conditioning components, for example. The processing circuit 172 may be operable to produce a value representing the shuttle motor 82 speed from an associated value received as input, for example. The processing circuit 172 may be operable to determine a rotational speed of the shuttle motor output shaft 86 defined as an average rotational speed during a time duration, for example. The time duration may be less than one second, for example. The processing circuit 172 preferably is operable to assign a value to a variable stored within the memory circuit 174 representing the shuttle motor 82 speed. In the first embodiment, the processing circuit 172 is preferably operable to receive as an input an indication that the shuttle motor 82 has rotated through a specified angle of rotation, which may be referred to as a shuttle motor 82 encoder "tick". The processing circuit 172 is operable to measure the time elapsed between receiving each shuttle motor 82 encoder tick, and thereby determine the shuttle motor 82 speed.

Block 228 also directs the processing circuit 172 in accordance with the first embodiment to determine whether to increment a projectile 14 counter stored in the memory circuit 174. In the first embodiment, the processing circuit 172 is operable to count the shuttle motor 82 encoder ticks and to determine therefrom whether a sufficient number of shuttle motor 82 encoder ticks have been received to indicate that an additional projectile 14 has been dispensed from the apparatus 10. The processing circuit 172 is preferably operable to increment the projectile 14 counter upon receiving and counting the appropriate number of shuttle motor 82 encoder ticks. In this manner, the apparatus 10 is preferably operable to count the number of projectiles 14 dispensed from the apparatus 10.

When block 228 has been executed, the processing circuit 172 is directed to execute block 230.

Block 230 directs the processing circuit 172 to receive as input a value associated with the current position of the remote speed control switch 162, and assigning that value, or an associated value calculated therefrom, to the desired dispensing rate, which preferably is stored within the memory circuit 174.

Block 232 then directs the processing circuit 172 to produce a shuttle motor 82 speed value in response to the shuttle motor 82 speed determined by block 228 and the desired dispensing rate determined by block 230. The processing circuit 172 preferably stores within the memory circuit 174 the shuttle motor 82 speed value. The apparatus 10 is operable to vary the power supplied to the shuttle motor 82, thereby regulating the shuttle motor 82 speed. In the first embodiment, the apparatus 10 uses pulse-width-modulation (PWM) techniques to vary the power supplied to the shuttle motor 82, however, other modulation techniques will be apparent to those of ordinary skill in the art and are contemplated within the scope of the present invention. The processing circuit 172 may be operable to compute a duty cycle for a digital signal, including possibly a digital signal produced at an output port of the processing circuit 172, associated with the shuttle motor 82 speed value. The apparatus 10, including possibly the processing circuit 172, is preferably operable to produce the digital signal such that it has a modulation frequency much greater than the frequency associated with required changes in power supplied to the shuttle motor 82. For example, the modulation frequency is preferably much greater than 100 Hz and typically is in the range of 500 Hz to 20 kHz. The modulation frequency may be about 10 kHz, for example. Rectification of the digital signal may produce a power signal that can be supplied, directly or indirectly through power amplification means, to the shuttle motor 82, for example.

In addition to the execution of block 232, the processing circuit 172 may be operable to limit the duty cycle to a specifiable limit, thereby advantageously reducing the likelihood of a jam condition of the apparatus 10 occurring and the likelihood of a projectile 14 becoming broken should a jam condition of the apparatus 10 occur.

When block 232 has been executed, the processing circuit 172 is directed to execute block 234.

Still referring to FIG. 24, block 234 directs the processing circuit 172 to determine whether a stall condition of the shuttle motor 82 is occurring, such as when a jam condition of the apparatus 10 exists. A stall condition may exist where the shuttle motor 82 speed has been below a critical shuttle motor 82 speed less than the shuttle motor 82 speed required to meet the desired dispensing rate of the apparatus 10 for a length of time. A stall condition indicates a jammed condition of the apparatus 10, such as when a projectile 14 has become jammed in the apparatus 10. The critical shuttle motor 82 speed is preferably between 0.1 and 20 revolutions per minute (RPM), and including being about 8 RPM. The length of time indicative of a stall condition is preferably between 0.1 seconds and 2 seconds, and may be about 0.4 seconds, for example. If the processing circuit 172 determines that the apparatus 10 is in a stall condition, then the processing circuit 172 is directed to execute block 236.

Block 236 directs the processing circuit 172 to execute steps to correct the stall condition.

Figure 25:
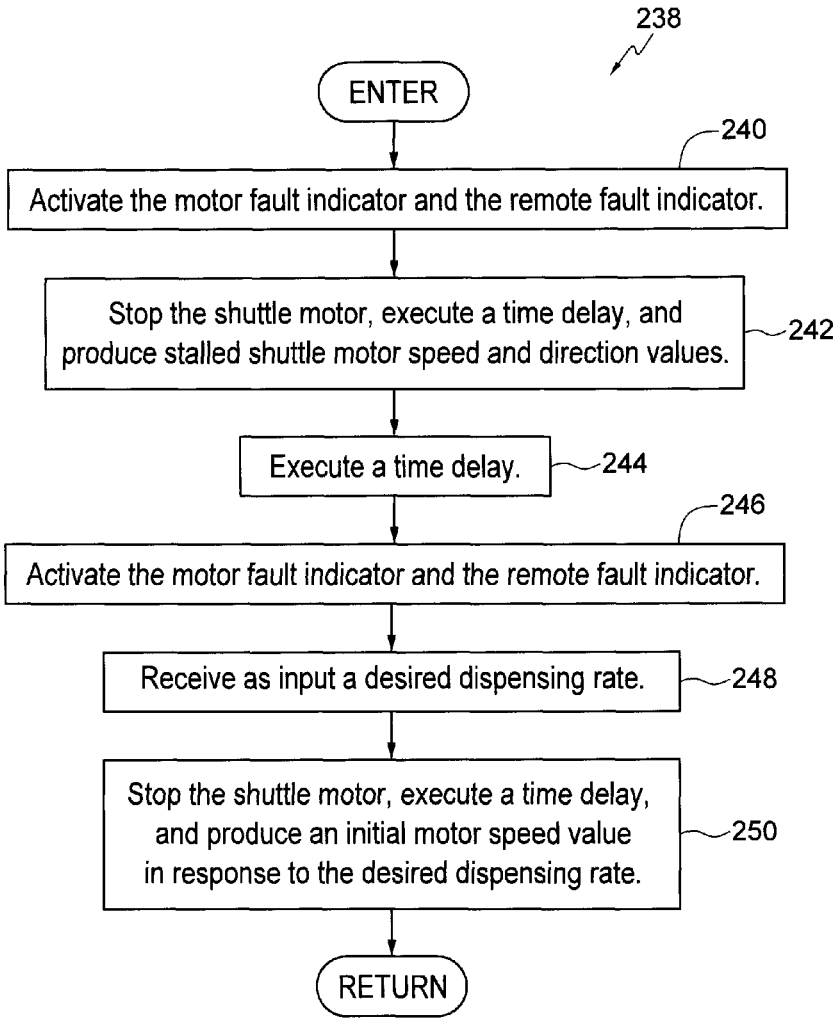
FIG. 25 is a flow diagram of steps of a stall condition correction method shown in FIG. 24.

Referring to FIG. 25, a method for correcting a stall condition in accordance with block 236 (FIG. 24) is shown generally at 238. Block 240 directs the processing circuit 172 to assign values to flags in the memory circuit 174 associated with the motor fault indicator 136 and the remote fault indicator 158 such that these indicators 136 and 158 are activated and steady.

Block 242 directs the processing circuit 172 to produce and assign values to variables in the memory circuit 174 associated with the shuttle motor 82 speed value such that the shuttle motor 82 becomes stopped; then execute a time delay to provide sufficient time for mechanical components of the apparatus 10 to come to a complete rest; and then produce and assign values to variables in the memory circuit 174 associated with the shuttle motor 82 speed value and the shuttle motor 82 direction, such that the shuttle motor 82 is caused to reverse its direction of rotation and is supplied with power to rotate in the reverse direction at a reverse rotation speed. The time delay executed when stopping the shuttle motor 82 is preferably between 0.1 and 2 seconds, and may be 350 milliseconds, for example. The reverse rotation speed is preferably a substantially constant speed, and may be substantially equal to the maximum initial speed (albeit in the reverse direction), for example.

Block 244 then directs the processing circuit 172 to execute a time delay during which the shuttle motor 82 is operating in the reverse direction. The time delay is preferably between 0.1 and 5 seconds, and may be about 2 seconds, for example. Additionally or alternatively, the processing circuit 172 may be operable to determine whether a specifiable number of shuttle motor 82 encoder ticks have been received such that the shuttle motor 82 has operated in the reverse direction for a sufficient number of revolutions, and/or fractional portion thereof.

Block 246 then directs the processing circuit 172 to assign values to flags in the memory circuit 174 associated with the motor fault indicator 136 and the remote fault indicator 158 such that these indicators 136 and 158 are de-activated.

Block 248 then directs the processing circuit 172 to receive as input a value associated with the current position of the remote speed control switch 162, and assigning that value, or an associated value calculated therefrom, to the desired dispensing rate, which is preferably stored within the memory circuit 174.

Block 250 then directs the processing circuit 172 to produce and assign values to variables in the memory circuit 174 associated with the shuttle motor 82 speed value such that the shuttle motor 82 becomes stopped; then execute a time delay to provide sufficient time for mechanical components of the apparatus 10 to come to a complete rest; and then determine and assign a value for an initial shuttle motor 82 speed in response to the desired dispensing rate, such that the shuttle motor 82 is caused to resume operation in the forward direction in accordance with the desired dispensing rate. The time delay executed when stopping the shuttle motor 82 is preferably between 0.1 and 2 seconds, and may be 350 milliseconds, for example. Portions of block 250 may be executed similarly, analogously or identically to the execution of block 220 (FIG. 22), for example. The initial shuttle motor 82 speed value produced by executing block 250 may be limited to a maximum initial speed such that the maximum initial speed is not exceeded during an initial phase of operation of the shuttle motor 82.

Still referring to FIG. 25, block 246 may be executed before, during or after the execution of blocks 248 and 250. The time delay of block 244 may include or exclude any processing time associated with executing blocks 246 to 250. When blocks 244 to 250 have been executed, the processing circuit 172 is directed to return to re-execute block 234 of FIG. 24.

Referring back to FIG. 24, if the processing circuit 172 determines by executing block 234 that the apparatus 10 is not in a stall condition, then the processing circuit 172 is directed to execute block 252.

Block 252 directs the processing circuit 172 to determine whether the RUN/STOP switch 140 is set to its STOP position. If the processing circuit 172 determines that the RUN/STOP switch 140 is not set to its STOP position (i.e. set to its RUN position), then the processing circuit is directed to execute block 254.

Block 254 directs the processing circuit 172 to determine whether the remote feed gate switch 160 is being set to its CLOSED position. If the processing circuit 172 determines that the remote feed gate switch 160 is not being set to its CLOSED position, the processing circuit is directed to execute block 228.

Blocks 228 to 254 form a loop whose execution is iterated until either the RUN/STOP switch 140 is removed from its RUN position or the remote feed gate switch 160 is removed from its OPEN position. Additionally or alternatively, the apparatus 10 may be operable to detect a change in the status of a switch, including detecting the removal of the RUN/STOP switch 140 from its RUN position and/or the removal of the remote feed gate switch 160 from its OPEN position, at any time the processing circuit 172 is executing code. Such detection may occur by executing an interrupt service routine or other event handler in response to the reception, including the asynchronous detection, of an interrupt request or other detection of a change in switch status, including detecting by polling, for example.

During iterations of the loop formed by blocks 228 to 254, the shuttle motor speed value is adjusted in response to changes in shuttle motor speed and the desired dispensing rate. In this manner, the apparatus 10 is operable to compensate for changes in load and other factors such that differences between the shuttle motor speed and that required to meet the desired dispensing rate are minimized. For example, the apparatus 10 is preferably operable to increase the power supplied to the shuttle motor 82 in response to the increased load occurring when the injector needle 96 is piercing a given projectile 14, such that undesirable variations in the reciprocating speed of the shuttle 78 are minimized.

The processing circuit 172 may be operable to determine the duty cycle in accordance with a control system theory. In the first embodiment, the processing circuit 172 is preferably operable to determine the duty cycle in accordance with a proportional-integral-derivative (PID) control system. However, the processing circuit 172 may be operable to determine the duty cycle in accordance with other feedback control systems, including a negative feedback control system.

Still referring to FIG. 24, if the processing circuit 172 determines in executing block 252 that the RUN/STOP switch 140 is set to its STOP position or determines in executing block 254 that the remote feed gate switch 160 is being set to its CLOSE position, then the processing circuit 172 is directed to return to execute block 256 of FIG. 20.

Referring back to FIG. 20, block 256 directs the processing circuit 172 to stop dispensing projectiles 14.

Figure 26:
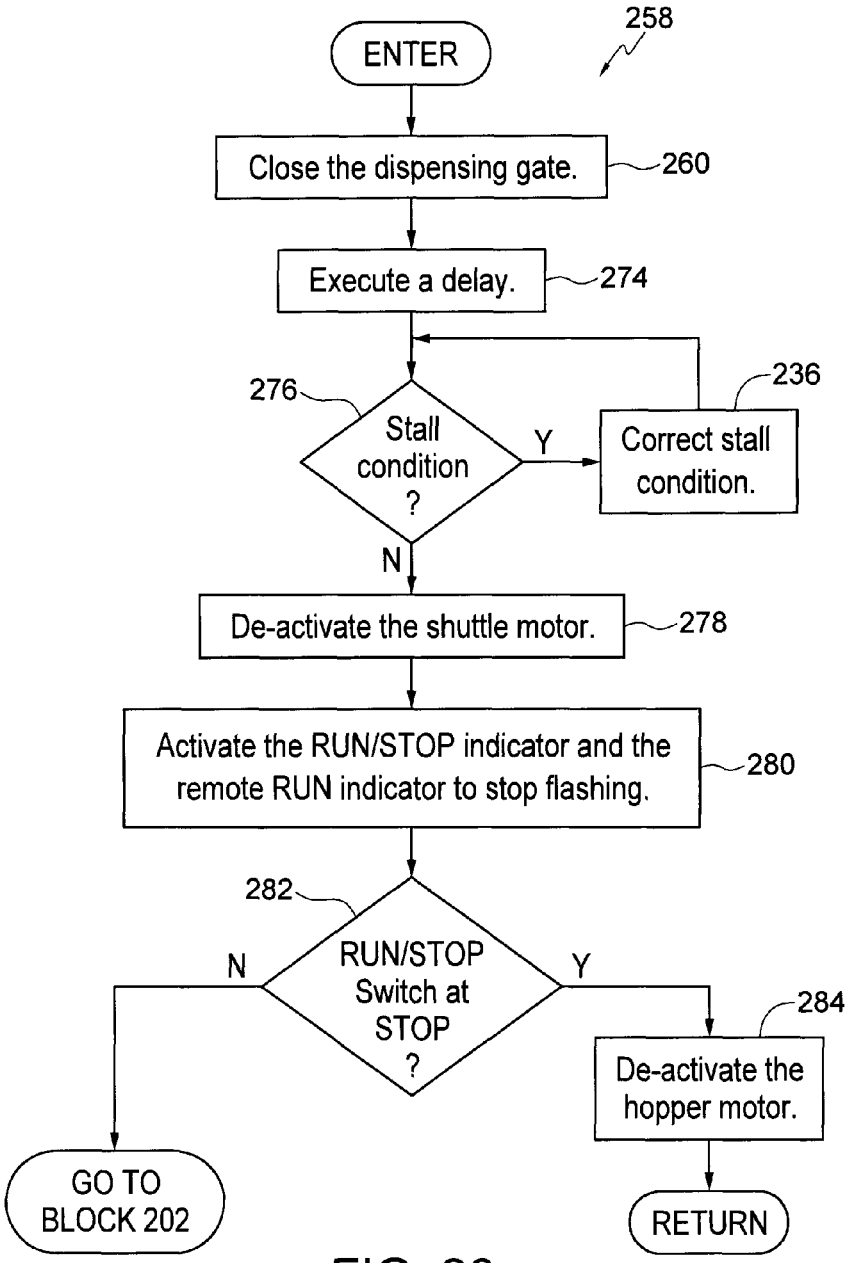
FIG. 26 is a flow diagram of steps of a stop dispensing method shown in FIG. 21.

Referring to FIG. 26, a method for stopping dispensing projectiles 14 in accordance with block 256 (FIG. 20) is shown generally at 258. Block 260 directs the processing circuit 172 to close the dispenser gate 42. Block 260 may be executed similarly, analogously or identically to the execution of block 194 described herein above and illustrated in FIG. 27. When the block 260 has been executed, the processing circuit 172 is directed to execute block 274.

Referring again to FIG. 26, block 274 directs the processing circuit 172 to wait during the elapse of a delay before continuing. The apparatus 10 is advantageously operable to continue operating the shuttle motor 82 after the dispenser gate 42 has been closed to purge the apparatus 10 of any projectiles 14 remaining in the apparatus 10. For example, in the case of an embodiment having two shuttle receptacles 80, reciprocating the shuttle 78 twice is typically sufficient to purge the apparatus of any projectiles 14 in the shuttle receptacles 80. The delay is preferably such that between two and ten revolutions of the shuttle motor output shaft 86 occur before the shuttle motor 82 is de-activated, and may be such that three revolutions occur, for example. The processing circuit 172 may determine an amount of time required for the appropriate number of revolutions of the shuttle motor output shaft 86 based on the shuttle motor 82 speed and/or the desired dispensing rate. Additionally or alternatively, the processing circuit 172 may be operable to determine the number of revolutions or fractions thereof of the shuttle motor output shaft 86 from input received from the shuttle motor 82. When block 274 has been executed, the processor circuit 172 is directed to execute block 276.

Block 276 directs the processing circuit 172 to determine whether a stall condition of the shuttle motor 82 is occurring. Block 276 may be implemented in a manner similarly, analogously and/or identically to block 234, for example. If the processing circuit 172 determines that the shuttle motor 82 is in a stall condition, then the processing circuit 172 is directed to execute block 236.

Block 236 directs the processing circuit 172 to execute steps to correct the stall condition in the manner previously described herein. When block 236 has been executed, the processing circuit 172 is directed to return to re-execute block 276.

Still referring to FIG. 26, if the processing circuit 172 determines by executing block 276 that the apparatus 10 is not in a stall condition, then the processing circuit 172 is directed to execute block 278.

Block 278 then directs the processing circuit 172 to produce a shuttle motor 82 speed value such that the shuttle motor 82 becomes de-activated and stops operation.

De-activation of the shuttle motor 82 when projectiles 14 are not being dispensed advantageously permits the processing circuit 172 to determine a value associated with the number of projectiles 14 dispensed from the number of cycles of the shuttle 78. The processing circuit 172 may be operable to determine the number of cycles of the shuttle 78 from the duration of time elapsed during which the shuttle motor 82 has been operating at a given shuttle motor 82 speed, for example.

The apparatus 10 is preferably operable to determine a current operation count of the number of projectiles 14 dispensed, which can be displayed on the display 132 and can be reset to zero by actuating the count reset switch 144. Typically, the current operation count is associated with the number of projectiles 14 dispensed since the count reset switch 144 had been actuated. The apparatus 10 is also preferably operable to determine and store in non-volatile memory of the memory circuit 174 a lifetime count of the number of projectiles 14 dispensed during the lifetime of the apparatus 10. Typically, the lifetime count is set to zero by the manufacturer prior to its first use by a purchaser. In some embodiments, the apparatus 10 is operable to perform other data logging tasks, including possibly determining when a series of projectiles 14 had been dispensed and determining where a given series of projectiles 14 had been dispensed.

Block 280 then directs the processing circuit 172 to assign values to flags in the memory circuit 174 associated with the RUN/STOP indicator 142 and the remote RUN indicator 156 such that these indicators 142 and 156 are continuously activated, thereby stopping any flashing effect and maintaining these indicators 142 and 156 steadily activated.

Block 282 then directs the processing circuit 172 to determine whether the RUN/STOP switch 140 is set to its STOP position. If the processing circuit 172 determines that the RUN/STOP switch 140 is not set to its STOP position (i.e. set to its RUN position), then the processing circuit 172 is directed to return to execute block 202 (FIG. 22). If the processing circuit 172 determines that the RUN/STOP switch 140 is set to its STOP position, then the processing circuit 172 is directed to block 284.

Still referring to FIG. 26, block 284 directs the processing circuit 172 to assign a value to the hopper motor flag within the memory circuit 174, such that the hopper motor 24 is or becomes de-activated. After block 284 has been executed, the processing circuit 172 is directed to return to execute block 286 shown in FIG. 20.

Referring back to FIG. 20, block 286 directs the processing circuit 172 to end the method 176. Additionally or alternatively, block 286 may direct the processing circuit 172 to return to execute block 178.

In addition to the methods described above, the apparatus 10 may be operable to cause short bursts of movement of the shuttle 78 by activating the shuttle motor 82, executing a time delay, and de-activating the shuttle motor 82. For example, the apparatus 10 may cause a short burst of movement of the shuttle 78 in response to momentary actuation of the jog switch 146 (FIGS. 2 and 4). The apparatus 10 is preferably operable to determine a low battery condition for the extinguisher battery 128 (FIG. 4), and produce an associated message on the display 132 (FIGS. 2 and 4) in response thereto. Additionally or alternatively, the apparatus 10 may be operable to determine whether the level of reactant in the reactant tank 118 is low, and produce an associated message on the display 132 (FIGS. 2 and 4) or otherwise activate an indicator in response thereto.

It is understood that the embodiments described and illustrated herein are merely illustrative of embodiments of the present invention. Other embodiments that would occur to those skilled in the art are contemplated within the scope of the present invention. For example, the processing circuit may execute blocks of code in a different order than that described herein above and illustrated in the Figures, including executing blocks of code in parallel. The invention may include variants not described or illustrated herein in detail. Thus, the embodiments described and illustrated herein should not be considered to limit the invention as construed in accordance with the accompanying claims.

What is claimed is:

1. An apparatus for dispensing from an aircraft projectiles containing incendiary material, the apparatus comprising:

(a) a base adapted to being removably mounted to the aircraft;

(b) a chute operable to expel the projectiles to fall away from the aircraft;

(c) a hopper operable to store discrete unitary unprimed projectiles;

(d) a feed mechanism cooperating with the hopper to extract unprimed projectiles from the hopper and provide a queue of unprimed projectiles;

(e) a dispenser gate connected to the feed mechanism, the dispenser gate having one or more gate passages and being operable to open to unblock movement of unprimed projectiles through the gate passages in response to a gate signal;

(f) an injector connected to the dispenser gate that receives unprimed projectiles from the dispenser gate and injects the projectiles at a dispensing rate with a reactant to prime the projectiles, and then conveys the primed projectiles to the chute; and (g) a controller operable to provide the gate signal to the dispenser gate and to control the dispensing rate of the injector in response to a desired dispensing rate, and wherein said controller is operable to detect a jammed condition of the apparatus.

2. The apparatus of claim 1 wherein said controller is operable to limit a momentum of said injector when injecting the projectiles during an initial phase of operation of the apparatus.

3. The apparatus of claim 1 wherein said controller is operable to correct said jammed condition.

4. The apparatus of claim 3 wherein:

a. the injector comprises a shuttle operable to reciprocate in response to output rotation of a shuttle motor;

b. the controller is operable to control the dispensing rate by controlling an output speed of the shuttle motor; and c. the controller is operable to receive as an input a first indication of the output rotation and operable to control the dispensing rate by varying electrical power supplied to the shuttle motor in response to the first indication.

5. The apparatus of claim 4 wherein the controller is operable to prevent the shuttle from starting to reciprocate until a shuttle delay has elapsed after the dispenser gate has been opened.

6. The apparatus of claim 5 wherein the controller is operable to limit a momentum of the injector when injecting the projectiles during an initial phase of operation of the apparatus.

7. The apparatus of claim 5 wherein the dispenser gate comprises a gate pin for closing each of the gate passages, the dispenser gate being dimensioned such that no more than one projectile fits in each gate passage between the gate pin and the shuttle.

8. The apparatus of claim 7 wherein the dispenser gate comprises a gate closing solenoid for urging the gate pin toward a blocking position when the gate closing solenoid is energized, and a gate locking pin for maintaining the gate pin in the blocking position when the gate closing solenoid is de-energized.

9. The apparatus of claim 5 wherein the controller is operable, in response to the dispenser gate being closed, to deactivate the shuttle motor after a purge delay has elapsed.

10. The apparatus of claim 4 wherein said injector is operable to inject the projectiles with an amount of reactant that is independent of said dispensing rate.

11. The apparatus of claim 4 wherein the controller is operable to count the number of the projectiles being dispensed in response to the first indication of the output rotation.

12. The apparatus of claim 4 wherein the controller is operable to control the dispensing rate by receiving as input a second indication of a desired dispensing rate, and varying electrical power supplied to the shuttle motor in response to the first and second indications.

13. The apparatus of claim 3 wherein the controller is operable to detect a jammed condition of the apparatus by determining that an output speed of the shuttle motor has been lower than a critical shuttle motor speed for at least a critical length of time.

14. The apparatus of claim 13 wherein the controller is operable to correct the jammed condition by causing the shuttle motor to operate in a reverse direction during a reverse direction time delay.

15. The apparatus of claim 1 wherein said injector is operable to inject the projectiles with an amount of reactant that is independent of said dispensing rate.

16. The apparatus of claim 1 wherein said controller is operable to count the number of the projectiles being dispensed.

17. The apparatus of claim 1 further comprising a fire extinguisher mechanism operable to contain extinguishing agent, the controller being operable to prevent dispensing of the projectiles when the fire extinguisher mechanism contains an insufficient amount of the extinguishing agent.

18. The apparatus of claim 17 further comprising electrical storage means to provide electricity to the fire extinguisher mechanism when electrical power is not otherwise being supplied to the apparatus.

* * * * *